US006815153B2

(12) United States Patent
Friday et al.

(10) Patent No.: US 6,815,153 B2
(45) Date of Patent: Nov. 9, 2004

(54) HIGH SPEED COLOR PHOTOGRAPHIC ELEMENT WITH IMPROVED GRANULARITY

(75) Inventors: James A. Friday, Rochester, NY (US); Roger A. Weiss, Webster, NY (US); Anabisdally I. Bodden, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/346,272

(22) Filed: Jan. 17, 2003

(65) Prior Publication Data

US 2004/0142288 A1 Jul. 22, 2004

(51) Int. Cl.[7] ..... G03C 1/46

(52) U.S. Cl. ..... 430/506; 430/505; 430/570; 430/572; 430/576; 430/581; 430/582; 430/583; 430/584; 430/585; 430/586

(58) Field of Search ..... 430/502, 503, 430/506, 570, 572, 576, 581–8

(56) References Cited

U.S. PATENT DOCUMENTS

| | | | | |
|---|---|---|---|---|
| 3,622,316 A | | 11/1971 | Bird et al. | |
| 5,091,293 A | * | 2/1992 | Nozawa et al. | 430/503 |
| 5,314,793 A | | 5/1994 | Chang et al. | |
| 6,143,486 A | | 11/2000 | Parton et al. | |
| 6,165,703 A | | 12/2000 | Parton et al. | |
| 6,218,088 B1 | * | 4/2001 | Arakawa | 430/351 |

OTHER PUBLICATIONS

Thomas L. Penner et al, *Photographic Science and Engineering*, "Spectral Shifts and Physical Layering of Sensitizing Dye Combinations in Silver Halide Emulsions", vol. 20, 1976, pp. 97–106.

Thomas L. Penner, *Photographic Science and Engineering*, "Electrophoresis of Spectral Sensitizing Dyes on Silver Halide: Evidence for Dye Layering", vol. 21, 1977, pp. 32–36.

IP.com publication 000006637D published Jan. 17, 2002, pp. 1–51.

U.S. application Ser. No. 10/346,582 filed Jan. 17, 2003 "Color Photographic Material With Improved Sensitivity" of Sharon G. Johnston et al.

U.S. application Ser. No. 10/346,745 filed Jan. 17, 2003 "A Method of Making A Silver Halide Photographic Material Having Enhanced Light Absorption and Low Fog" of David R. Foster et al.

U.S. application Ser. No. 10/347,014 filed Jan. 17, 2003 "Silver Halide Material Comprising Low Stain Antenna Dyes" of Richard L. Parton et al.

* cited by examiner

*Primary Examiner*—Geraldine Letscher
(74) *Attorney, Agent, or Firm*—Sarah Meeks Roberts

(57) ABSTRACT

This invention relates to a silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein said photographic element has an ISO speed rating of 800 or greater and has an integrated RMS green granularity equal to or less than 11.2. In a preferred embodiment the magenta dye image forming unit contains silver halide emulsion layers of differing sensitivities, said layers comprise at least a slow, a fast and an intermediate layer; and at least one layer of intermediate sensitivity contains a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

44 Claims, No Drawings

HIGH SPEED COLOR PHOTOGRAPHIC ELEMENT WITH IMPROVED GRANULARITY

FIELD OF INVENTION

This invention relates to a silver halide multilayer photographic element exhibiting improved granularity with linear sensitometric curveshape. In one embodiment the element comprises a dye layered emulsion in the intermediate speed imaging layer of one of the dye image forming units of the element.

BACKGROUND OF THE INVENTION

Photographic sensitivity can be measured in various ways. One method commonly practiced in the art was first suggested by Hurter and Driffield in the nineteenth century. That method, which is described in numerous references (for example, The Theory of the Photographic Process, $4^{th}$ edition, T. H. James editor, Macmillan Publishing Co., New York, 1977), is to expose an emulsion coated onto a planar substrate for a specified length of time through a filtering element, or a step tablet interposed between the coated emulsion and light source. The step tablet modulates the light intensity in a series of uniform steps of constant factors by means of the constructed increasing opacity of the filter elements of the tablet. As a result the exposure of the emulsion coating is spatially reduced by this factor in discontinuous steps in one direction, remaining constant in the orthagonal direction. After exposure for a time required to cause the formation of a developable image through a portion, but not all of the exposure steps, the emulsion coating is processed in an appropriate developer, either black and white or color, and the densities of the image steps are measured with a densitometer. A graph of the exposure on a relative or absolute scale, usually in logarithmic form, defined as the irradiance multiplied by the exposure time, plotted against the measured image density created during development, can then be constructed. The graph so produced, often referred to as the characteristic profile or H&D (see FIG. 1 in U.S. Pat. No. 5,314,793), demonstrates the way in which an emulsion responds to exposure and development and provides valuable insight into the photographic performance to be expected from the imaging element.

The characteristic profile in negative working photographic silver halide systems typically has an "s" shape. The displacement of the characteristic profile above zero density is referred to as minimum density (Dmin) or fog. Depending on the purpose, a suitable image density on the characteristic profile is chosen as a reference (for example 0.15 or 0.20 density above that formed in a step which received too low an exposure to form detectable exposure-related image). The exposure required to achieve that reference density can then be determined from the constructed graph, or its electronic counterpart. The inverse of the exposure to reach the reference density is designated as the emulsion coating sensitivity S. The value of $\log_{10}S$ is termed the speed. The exposure can be either monochromic over a small wavelength range or consist of many wavelengths over a broad spectrum as already described. Typically as exposure onto an emulsion coating is increased, at some point the characteristic profile curve rolls over and produces no further increase in density with increased exposure. The maximum density of the characteristic profile is referred to as Dmax. The displacement along the exposure scale of the characteristic profile between the first incremental density above Dmin and the last incremental density before Dmax defines the exposure latitude. The longer the exposure latitude the lower the risk of image information being lost through over or under exposure during imaging. An average photographic scene is spread out over an exposure latitude of about 1.2 logE (4 stops). Critical scenes containing both dark shadows and reflective highlights can contain information spread out over a much larger exposure latitude. An exposure latitude of 1.8 logE (6 stops) offers sufficient margin for recording extremely demanding scenes. The slope or gamma of the characteristic profile (delta density/delta Log Exposure or first derivative of the H&D curve) is usually measured over some segment of the curve bridging mid-scale density. Silver halide photographic films also strive to maximize the linearity of the mid-scale density portion of the characteristic profile. A long linear mid section of the characteristic profile means that the film will have a predictable and desirable linear relationship between exposure and density over many varied levels of exposure.

Although the image dye characteristic profile of color multilayer photographic element is useful in assessing imaging capability and quality, one important image property that requires separate inquiry is image noise—i.e., granularity. It is a long-standing objective of color photographic origination materials to maximize the overall response to light while maintaining the lowest possible granularity. Increased photographic sensitivity to light (speed) allows for improved image captured under low light conditions or improved details in the shadowed regions of the image. Sensitivity is much more important with origination materials than with print materials, the latter depending entirely on operator supplied light. In general, the overall light sensitivity provided by the light sensitive silver halide emulsions is a function of the size of the emulsion grains. Larger emulsion grains capture more light. Upon development, the captured light is ultimately converted into dye deposits that constitute the reproduced image. The granularity exhibited by these dye deposits is directly proportional to the grain size of the silver halide emulsion. Larger silver halide emulsion grains have higher sensitivity to light but also lead to higher granularity in the reproduced image.

As the photographic industry evolves, conventional film and digital technology coexist as tools to both capture and manipulate information. Information captured on film is now often scanned and digitally manipulated before it is outputted to a final display format. Maximizing exposure latitude, enhancing the curveshape linearity and granularity (signal to noise) of photographic origination film lessens the amount of work needed to correct and manipulate digitally scanned film information. Co-optimizing to these performance characteristics expands the capabilities of photographic film as an image capture and recording media.

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with a high extinction coefficient as a J-aggregated cyanine dye, adsorbs only a small fraction of the light impinging on it per unit area. The advent of tabular emulsions allowed more dye to be put on the grains due to increased surface. However, in most photographic systems, it is still the case that not all the available light is being collected. Increasing the light absorption cross-section of the emulsion grains can lead to an increased photographic sensitivity. The need is especially great in the green sensitization of the magenta layer of color negative photographic elements. The eye is most sensitive to magenta dye and this layer has the largest impact on image structure (e.g., granularity) and color reproduction. High speed in this layer can be used to obtain improved color and image quality characteristics.

One way to achieve greater light absorption is to increase the amount of spectral sensitizing dye associated with the individual grains beyond monolayer coverage of dye. Some proposed approaches are described in the literature by G. R. Bird, *Photogr. Sci. Eng.,* 18, 562 (1974). One useful method is to have two or more dyes form layers on the silver halide grain. Penner and Gilman described the occurrence of greater than monolayer levels of cyanine dye on emulsion grains, *Photogr. Sci. Eng.,* 20, 97 (1976): see also Penner, *Photogr. Sci. Eng.,* 21, 32 (1977). In these cases, the outer dye layer adsorbed light at a longer wavelength than the inner dye layer (the layer adsorbed to the silver halide grain). Bird et al. in U.S. Pat. No. 3,622,316, described a similar system. A requirement was that the outer dye layer absorb light at a shorter wavelength than the inner layer. The problem with early dye layering approaches was that the dye layers produced a very broad sensitization envelope. This would lead to poor color reproduction since, for example, the silver halide grains in the same color record would be sensitive to both green and red light.

More recently Parton et al. (U.S. Pat. Nos. 6,143,486 and 6,165,703) disclosed a more practical approach to form more than one layer on silver halide emulsion grains that can afford increased light absorption. These dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation–π interactions, etc., or by in situ bond formation. The inner dye(s) is absorbed to the silver halide grains and contains a least one spectral sensitizing dye. The outer dye layer(s) (also referred to here in as an antenna dye layer(s)) absorbs light at an equal or higher energy (equal or shorter wavelength) than the adjacent inner dye layer(s). The light energy emission wavelength of the outer dye layer overlaps with the light energy absorption wavelength of the adjacent inner dye layer. A particularly useful configuration involves silver halide grains sensitized with at least one dye containing at least one anionic substituent and at least one dye containing at least one cationic substituent, wherein the dye layers are held together by non-covalent forces or by in situ bond formation. The application of layered dye technology has focused primarily on improving photographic sensitivity (speed) of the fastest emulsion components with minimal granularity penalty.

PROBLEM TO BE SOLVED

It is a fundamental problem in modern color photography to minimize signal to noise (granularity) of a silver halide element while maximizing light sensitivity (speed), exposure latitude and linearity of the photographic response curve (characteristic profile).

SUMMARY OF THE INVENTION

This invention provides a silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein said photographic element has an ISO speed rating of 800 or greater and has an integrated RMS green granularity equal to or less than 11.2.

It further provides a silver halide photographic element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein at least one of the dye image forming units contains layers of differing sensitivities, said layers comprise at least a slow, a fast and an intermediate layer and the layer of intermediate sensitivity contains a silver halide emulsion comprising silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer. In one embodiment the magenta dye forming layer comprises the dye layered emulsion.

The photographic elements of this invention demonstrate improved granularity at high speeds. They further demonstrate improved linearity. This advantageous co-optimization of photographic sensitivity, granularity and linear exposure latitude was a completely unexpected advantage of utilizing dye layering in the intermediate record of a color negative film. These improved performance characteristics are particularly valued in consumer and professional color negative as well as color negative motion picture origination films where high magnification and digital scanning applications continue to push the demands for improved images structure.

DESCRIPTION OF PREFERRED EMBODIMENT

The invention is generally as described above. Typically, the color silver halide photographic element useful in the present invention comprise a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. It is preferred that the color silver halide elements are negative working silver halide elements. It is also preferred that the silver halide photographic elements are capture or origination elements such a color negative film or a motion picture origination film.

In one embodiment the photographic element has an ISO speed rating equal to or greater than 800 and has an integrated RMS Green Granularity equal to or less than 11.2, and more preferably an integrated RMS Green granularity equal to or less than 10.6. In another embodiment the photographic element has an ISO speed rating equal to or greater than 400 and has an integrated RMS Green Granularity equal to or less than 10.6. "ISO speed" means the speed determined in accordance with ANSI PH2.27-1988, corresponding to the logH exposure value at a density of 0.15 above Dmin on a Status M density plot. By having an ISO speed rating of 800 or 400 it is meant that the speed of the film falls within or above the ISO speed range corresponding to plus or minus 0.05 logH.

The color negative photographic element is exposed through a step tablet employing the appropriate exposure illuminant. Most consumer color negative films are usually designed for daylight exposure (5500K) while Motion Imaging origination films are usually engineered to function best with Tungsten (3200K) illuminant sources. The photographic element is developed for the standard times using the appropriate standard commercial processing methods. The Kodak ECN-2 Process is most often used to develop motion imaging color origination films. A complete description of the Kodak ECN-2™ Process is contained in the Kodak H-24 Manual (Manual for Processing Eastman Motion Picture Films; H-24 Manual; Eastman Kodak Company, Rochester, N.Y.) the description of which is incorporated herein by reference. The Kodak C-41 Process is most often used to develop Color Negative films and is described in *The British Journal of Photography Annual* of 1988, pages 191–198, the description of which is incorporated herein by reference.

Graininess is the subjective sensation of a mottled random patter observed by a viewer who sees small local density variations in an area of a photographic image that otherwise has uniform density. Granularity is an objective measure of the local density variations that produce the sensation of graininess. Granularity of a color multilayer photographic element is measured in the following manner. After exposure of the multilayer photographic element through a steptablet with 0.2 logH increments, followed by development through the appropriate photographic process, the cyan, magenta and yellow optical image dye densities are measured for each step of the stepwise exposure using a microdensitometer with a 48 $\mu$m aperture. Characteristic profile curves for the individual red, green and blue sensitive units within the multilayer elements are generated. Photographic sensitivity (speed point) for a multilayer sample is measured in log units as 100*(1-logH) where H is the exposure in lux-sec necessary to produce a density 0.20 above D-min. Simultaneously, granularity resulting from the stepwise exposure and processing of the multilayer element is determined by the RMS method (see The Theory of the Photographic Process, $4^{th}$ edition, T. H. James editor, Macmillan Publishing Co., New York, 1977) from multiple readings of each step with the 48 $\mu$m aperture microdensitometer. Specifications for the design and application of microdensitometer for the measurement of granularity can be found in ANSI/13A IT2.40-2002. RMS granularity is the Root-Mean-Squared standard density deviation ($\delta$d) or local density variability in an area of overall uniform density. The RMS granularity instrument should be calibrated to measure American National Standard diffuse visual density (PH2.19-1976). The RMS ($\delta$d) granularity from a stepwise exposure of a multilayer sample is measured at 0.2 logE increments from the speed point through +1.8 logE (6 stops) above the speed point for each of the red, green and blue channels. The RMS ($\delta$d) values for each of the red, green and blue channels over the 6 stop exposure range is squared, summed and averaged. The resulting integral is multiplied by 1000. This defines the Integrated red, green or blue RMS Granularity for a given multilayer photographic element.

In another embodiment of the invention the silver halide photographic element comprises a dye layered silver halide emulsion as described in more detail below. Preferably this embodiment meets the granularity requirement described above. In this embodiment at least one of the dye image forming units contains silver halide emulsion layers of differing sensitivities. The layers comprise at least a layer having slow sensitivity, a layer having fast sensitivity and a layer having intermediate sensitivity. There may be more than one intermediate layer. At least one layer having intermediate sensitivity contains a silver halide emulsion comprising silver halide grains having associated therewith at least two dye layers. More than one intermediate dye layer may contain the dye layering. In one preferred embodiment the slow layer may also comprise dye layering. The dye layers comprise (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation–$\pi$ interactions, etc. or by in situ bond formation. The inner dye layer(s) is adsorbed to the silver halide grains and contains at least one spectral sensitizer. The outer dye layer(s) (also referred to as an antenna dye) absorbs light at an equal or higher energy (equal or shorter wavelength) than the adjacent inner dye layer(s). The light energy emission wavelength of the outer dye layer overlaps with the light energy absorption wavelength of the adjacent inner dye layer. Preferably the dye image forming unit containing the dye layered silver halide emulsion is the magenta dye image forming unit.

Dye 1 may be, for example, a cyanine dye, a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferably Dye 1 is a cyanine dye.

In one preferred embodiment Dye 1 comprises at least one anionic substituent. Examples of anionic substituents are alkyl groups containing acid salts. Acid salt are salts of sulfonic acids, sulfato groups, salts of phosphonic acids, salts of carboxylic acids, and salts of nitrogen acids, such as imides, N-acylsulfonamides, and N-sulfonylsulfonamides. The preferred acid salt substituents are salts of sulfonic acids, carboxylic acids, and nitrogen acids. The alkyl groups bearing the acid salt substituent may be further substituted. Some specific examples of preferred alkyl groups with acid salt substituents include, but are not limited to: 2-sulfoethyl, 3-sulfopropyl, 3-sulfobutyl, 4-sulfobutyl, 3-sulfo-2-hydroxypropyl, sulfoethylcarbamoylmethyl, 2-carboxyethyl, 3-carboxypropyl, 2-sulfo-2-carboxyethyl, methanesulfonylcarbamoylmethyl, and the like.

Dye 2 may be, for example, a cyanine dye, a merocyanine dye, arylidene dye, complex merocyanine dye, styryl dye, hemioxonol dye, oxonol dye, anthraquinone dye, triphenylmethane dye, azo dye type, azomethine dye, or a coumarin dye. More preferably Dye 2 is not a cyanine dye. Most preferably Dye 2 is a merocyanine dye. A merocyanine dye has one basic nucleus and one acidic nucleus separated by a conjugated chain having an even number of methine carbons (see *The Theory of the Photographic Process,* 4th edition, T. H. James, editor, Macmillan Publishing Co., New York, 1977 for an explanation of basic and acidic nuclei).

Dye 2 preferably has at least one cationic substitutent. The term "cationic substituent" includes a substituent which can be protonated to become a cationic substituent. Examples of positively charged substituents are 3-(trimethylammonio) propyl), 3-(4-ammoniobutyl), 3-(4-guanidinobutyl) etc. Other examples are any substitutents that take on a positive charge in the silver halide emulsion melt, for example, by protonation such as aminoalkyl substitutents, e.g. 3-(3-aminopropyl), 3-(3-dimethylaminopropyl), 4-(4-methylaminopropyl), etc. In a preferred embodiment of the invention Dye 1 comprises at least one anionic substiutent, and Dye 2 comprises at least one cationic substitutent.

Specific spectral sensitizing dyes (Dye 1) and antenna dyes (Dye 2) useful in the invention and methods of dye layering are described in detail in Parton, et al. European patent application publications EP 985,967, corresponding to U.S. Pat. No. 6,361,932, and EP 1,199,595, corresponding to U.S. application Ser. No. 09/690,068, filed Oct. 16, 2000, U.S. Pat. Nos. 6,143,486, 6,165,703, 6,312,883, Deaton, et al., U.S. Pat. No. 6,331,385 and Andrievsky, et al., U.S. Pat. No. 6,329,133, the entire contents of which are herein incorporated by reference. The dyes of the commonly-assigned and co-filed U.S. patent application of Parton et al., SILVER HALIDE MATERIAL COMPRISING LOW STAIN ANTENNA DYES, is also incorporated herein by reference. Dye 1 and Dye 2 are also described in detail in "Technology Useful in Combination With Antenna Dyes" IP.com, Publication 000006637D, (IPCOM000006637D), published Jan. 17, 2002, pp. 1–51. Also discussed in the above references are methods to determine if dye layering has occurred.

In one embodiment the dye image forming unit containing the dye layered silver halide emulsion has a linearity of less than 0.10, and more preferably less than 0.06. In a preferred embodiment the dye image forming unit meeting the above criteria is the magenta image dye forming unit. Linearity of the characteristic profile curve of a photographic element may be determined in the following manner. A straight line is drawn on the characteristic profile curve of each multi-layer sample from the speed point to +1.8 logE above the speed point. The sum total of the absolute density differences at 0.2 logE intervals between the straight line and characteristic profile curves is herein defined as Linearity. As the Linearity value of a characteristic profile curve approaches zero, the segment of the characteristic profile curve corresponding to mid-scale density begins to resemble a perfectly straight line.

In one embodiment of the invention development promoting agents are added to the layer of highest sensitivity also which also comprises a dye layered emulsion. The development promoting agent use in the invention can be any of those known in the art, as for example, in U.S. Pat. No. 6,455,242 and U.S. Pat. No. 6,319,660. These are generally compounds that have a minimum of three heteroatoms that do not react with oxidized developer and have a ClogP (a calculated measure of hydrophobicity as described in the references above) sufficient to increase the speed or light sensitivity of an imaging layer compared to the same layer without the compound. Among the classes of compounds that contain a minimum of three heteroatoms and can be included in the invention when appropriately substituted to increase hydrophobicity are: triazoles, oxadiazoles, thiadiazoles, oxathiazoles, thiatriazoles, benzotriazoles, tetrazoles, mercaptotetrazoles, selenotetrazoles, mercaptothiadiazoles, mercaptotriazoles, mercaptooxadiazoles, telleurotetrazoles, benzisodiazoles, thioureas, purines and other polyazaindenes. These compounds may be prepared by the appropriate methods described within these references. Formulations useful for the purpose of the invention have the desired overall hydrophobicity (as measured by ClogP) and do not cause a significant inhibition of silver development.

In general, heterocyles that contain at least three heteroatoms are preferred. Among the more desirable classes of speed improving heterocycles of this invention are tetrazindenes (including purines), triazoles (including benzotriazoles), tetrazoles, thiadiazoles and oxadiazoles. The minimum ClogP for speed improvement may vary somewhat for each class of compound useful in this invention. Most desirable are purines with a ClogP of at least 6.2, or more preferably at least 6.8 or most suitably at least 7.2; triazoles with a ClogP of at least 8.75, or more preferably at least 9.0 or most suitably at least 9.25 benzotriazoles with a ClogP of at least 7.8, or more preferably at least 8.2 or most suitably at least 9.0; tetrazoles at least 6.5 or more preferably at least 7.0 or most preferably at least 7.5; or thiadiazoles or oxathiazoles with a ClogP of at least 7.6, or more preferably at least 7.9 or most suitably at least 8.2.

The development promoting agents useful in the invention are not couplers and do not react with oxidized developer (Dox) to generate dyes or any other product. It is desired that the compounds do not undergo any significant amounts (less than 5–10%) of chemical or redox reaction directly with oxidized color developer. They are colorless. They are stable to other components of the processing solutions and do not contain substituents that undergo substantial amounts of chemical reaction in any of the processing solutions.

An important feature of the development promoting agents of the invention is their hydrophobicity which is related to their octanol/water partition coefficient (logP). In order to maximize the photographic effect, the partitioning into water cannot be so low that the material is unable to reach the surface of the emulsion grains. It has also been found that the partitioning into water cannot be too high. Because it can be difficult to measure logP values above 3, a model can be used to compute an estimate of logP, called ClogP that defines the limits of the invention. The model used is MEDCHEM Version 3.54, which is a software program produced by the Medicinal Chemistry Project at Pomona College in California. Calculation methods for ClogP are detailed in U.S. Pat. No. 6,455,242 and U.S. Pat. No. 6,319,660. For the purposes of this invention, the ClogP refers to neutral molecules, even if they would be ionized or protonated (either fully or in part) at the processing pH or at the ambient pH of the photographic film. Thus, in practice, it is highly desirable that the substituents of the compound of the invention do not contain additional very low $pK_a$ (<7) groups such as sulfonic or carboxylic acids nor very basic groups (pKa of conjugate acid <10) such as a tertiary amino group (unless such an amino group is attached to a heterocylic ring such that it is conjugated to a nitrogen atom, in which case its basicity is greatly reduced) since they require an increase in the size and amount in the rest of the hydrophobic substituents in order to meet the overall ClogP requirements.

For each compound of the invention, as the laydown is increased a threshold level is reached following which the improvement gradually increases with laydown, after which the improvement then levels off at a compound specific maximum level. It will be appreciated that the amount is also a function of other variables such as the location and number of layers in which the compound is located, the solvent used, and film dimensions. Thus, it is desirable to have enough laydown of the compound in order to obtain the desired improvement. Typical effective levels range from 0.03 to 0.15 mmole per squared meter coverage, depending on the location of the specific DPA. When the compound is present in a sensitized layer, the ratio of compound to silver is suitably at least 0.4 mmol of compound per mol of silver halide and, more preferably, at least 4.0 mmol of compound per mol of silver halide and, most preferably, at least between 5–10 mmol per mol of silver halide.

The development promoting agents used in the invention can be added to a mixture containing silver halide before coating or, more suitably, be mixed with the silver halide just prior to or during coating. In either case, additional components like couplers, doctors, surfactants, hardeners and other materials that are typically present in such solutions may also be present at the same time. The materials are not water-soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). The preferred permanent solvents used with the materials of the invention are those with ClogP of 5.0 or greater and beta values of 0.4 or greater or more preferably, beta values of 0.5 or greater. Preferred classes of solvents are carbonamides, phosphates, alcohols and esters. When a solvent is present, it is preferred that the weight ratio of compound to solvent be at least 1 to 0.5, or most preferably, at least 1 to 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials used in the invention may also be dispersed as an admixture with another component of the system such as a coupler or an oxidized developer scavenger so that both are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The following are examples of DPA compounds, along with the corresponding ClogP values, that are useful in this invention:

DPA-1: (6.91)

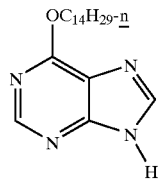

DPA-2: (8.32)

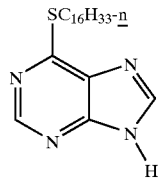

DPA-3: (7.84)

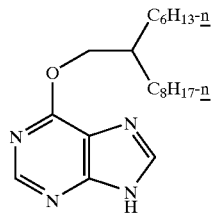

-continued
DPA-4: (6.98)
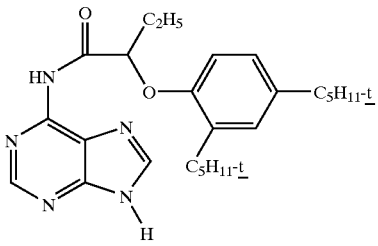
DPA-5: (7.99)
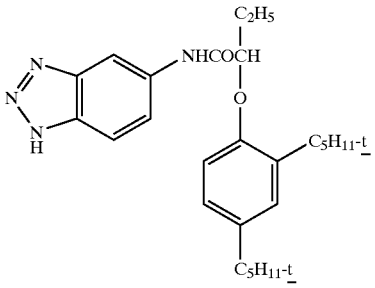
DPA-6: (10.66)
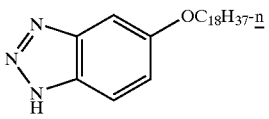
DPA-7: (12.07)
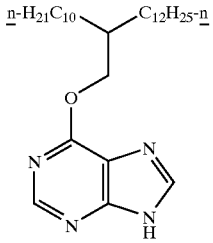
DPA-8: (10.23)
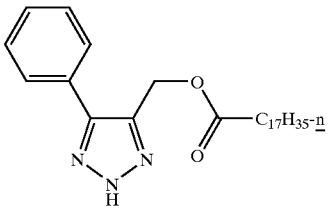
DPA-9: (9.04)
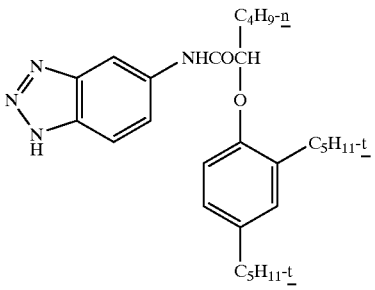
DPA-10:
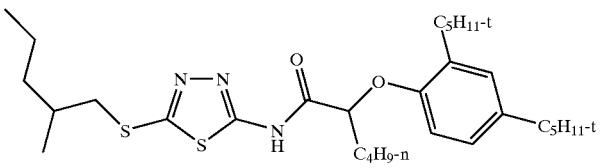

-continued

DPA-11:

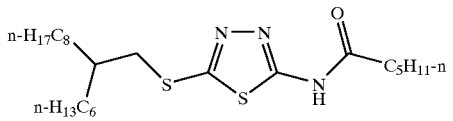

DPA-12:

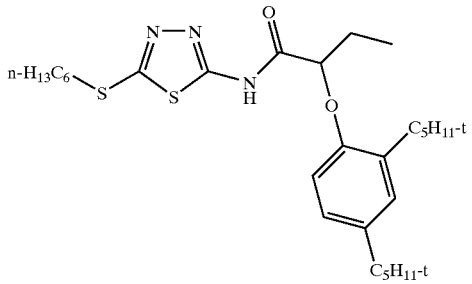

In one embodiment of the invention the dye image forming unit which comprises an intermediate layer comprising a dye layered emulsion is a magenta dye image forming unit and the slow layer of said unit contains a certain two equivalent 5-pyrazolone coupler. The magenta image couplers useful in this invention are two equivalent 5-pyrazolones such as those described in U.S. Pat. No. 5,262,292; U.S. Pat. No. 5,389,504; U.S. Pat. No. 5,200,309; U.S. Pat. No. 5,250,405; U.S. Pat. No. 5,256,528; U.S. Pat. No. 5,350,667; U.S. Pat. No. 5,376,519; U.S. Pat. No. 5,441,851; U.S. Pat. No. 5,462,848; U.S. Pat. No. 5,667,946; DE 19516166; JP 02151857; U.S. Pat. No. 6,218,097; DE 19525666 US2002045138 or two equivalent pyrazolotriazole couplers such as those described in U.S. Pat. No. 5,389,504; U.S. Pat. No. 5,985,532; U.S. Pat. No. 5,256,529; U.S. Pat. No. 5,270,156; U.S. Pat. No. 5,236,819; U.S. Pat. No. 5,118,591; U.S. Pat. No. 4,959,300 and U.S. Pat. No. 4,880,733. These couplers may be prepared by the appropriate methods described within these references.

Two equivalent 3-amido-5-pyrazolones are preferably according to Formula (I):

(Formula I)

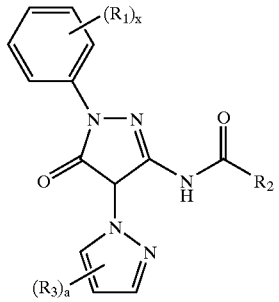

where $R_1$ and $R_3$ are independently selected from alkyl, aryl, alkoxy or aryloxy, alkylthio or arylthio, sulfoxyl, sulfonyl, sulfamoyl

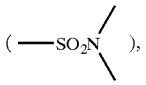

halo such as fluoro, chloro, bromo or iodo, cyano, thiol, hydroxy, nitro, —O—CO—, —O—$SO_2$—, a heterocyclic group such as furanyl or morpholino, a carbonyl group such as keto, carboxylic acid (—$CO_2H$), carboxylate ester (—$CO_2$—) or carbamoyl

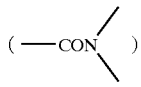

or an amino group such as a primary, secondary or tertiary substituted nitrogen, carbonamido (>NCO—) or sulfonamido (>$NSO_2$—); $R_2$ is an alkyl or aryl group; x is 1–5 and a is 1–3. More preferred couplers are where $R_3$ is hydrogen.

The two equivalent 3-anilino-5-pyrazolones are preferably according to Formula (II):

(Formula II)

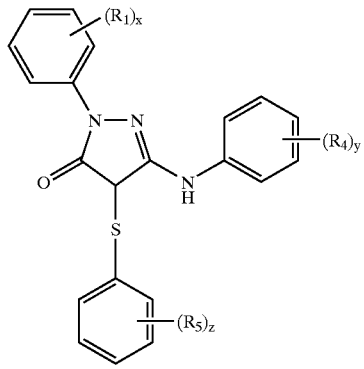

where $R_4$ and $R_5$ are independently defined the same as $R_1$ and x, y and z are independently 1–5.

The most preferable 3-anilino-5-pyrazolones are according to Formula (IIa):

(Formula IIa)

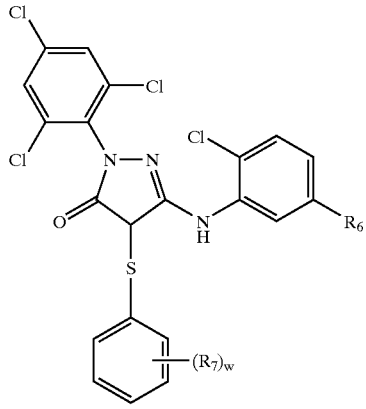

where $R_6$ is an amino, carbamoyl group, sulfamoyl, or carbonyl group that contains at least 8 carbon atoms and $R_7$ is selected from an amino, carbamoyl, alkyl or alkyloxy group with w=1 or 2 (if w=2, $R_7$ can be the same or different).

Some examples of 2 equivalent 5-pyrazolone magenta couplers useful in the invention are:

M-1:

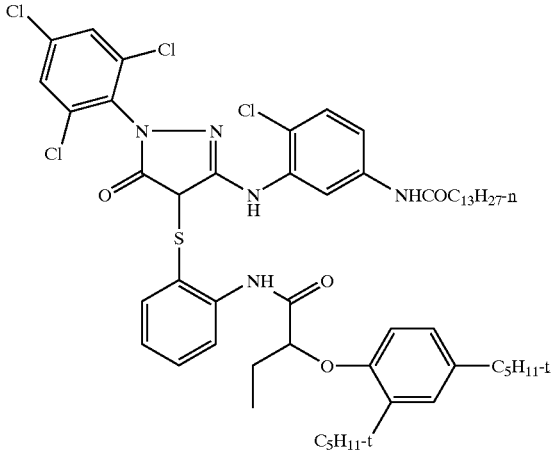

M-2:

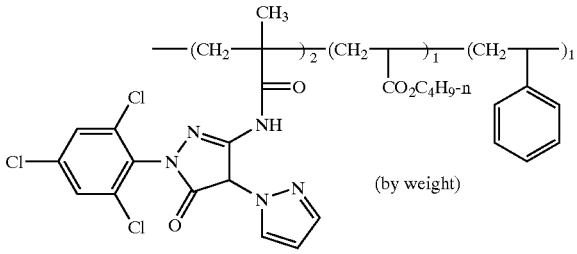

(by weight)

-continued

M-3:

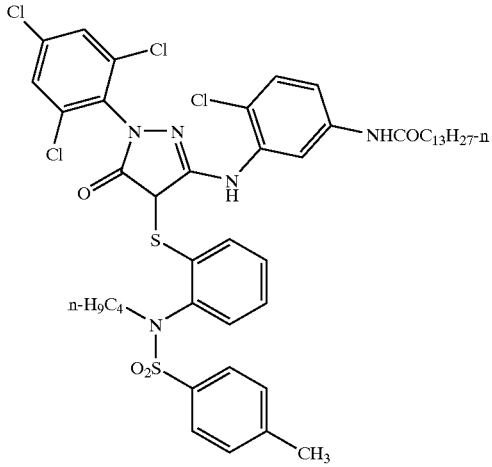

M-4:

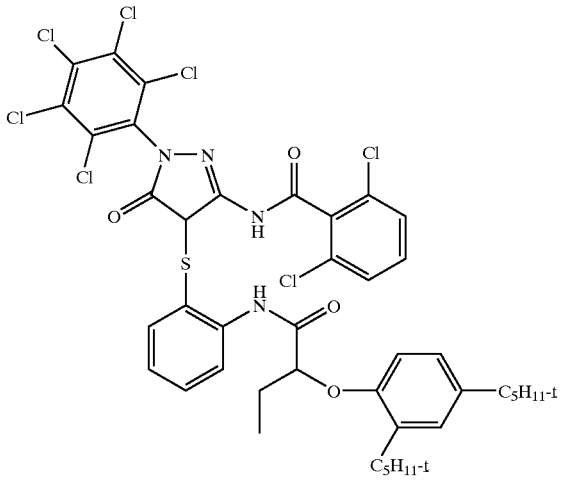

M-5:

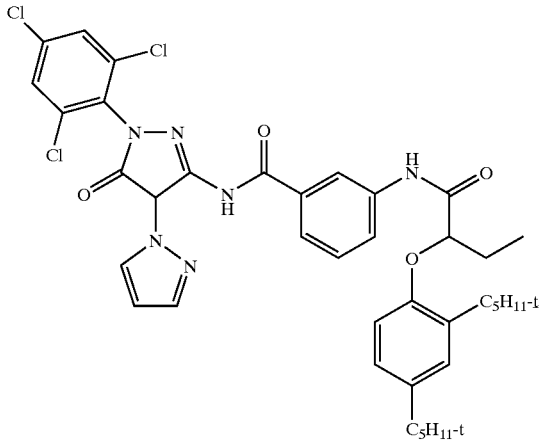

Preferred two equivalent pyrazolotriazole couplers can be either according to Formulas IIIa or IIIb:

(Formula IIIa)

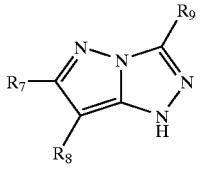

(Formula IIIb)

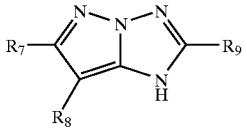

where $R_7$ is an alkyl, aryl, alkyloxy or aryloxy group, $R_8$ is any coupling group known in the art and $R_9$ is an alkyl or aryl group containing at least 8 carbon atoms.

More preferred pyrazolotriazole couplers according to Formula IIIa are according to Formula IIIa1:

(Formula IIIa1)

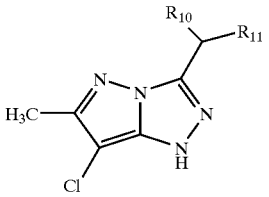

where $R_{10}$ is an alkyl or aryl group and $R_{11}$ is nitrogen or oxygen. More preferred couplers according to Formula IIIb are according to Formula IIIb1:

(Formula IIIb1)

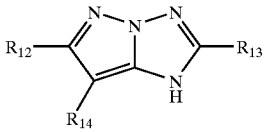

where $R_{12}$ is an alkyl or alkyloxy group; $R_{13}$ is an alkyl or aryl group; and $R_{14}$ is a chloro, aryloxy or pyrazole group.

Some examples of 2 equivalent pyrazolotriazole magenta couplers useful in the invention are:

M-6:

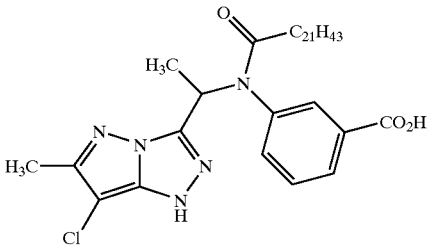

-continued

M-7:

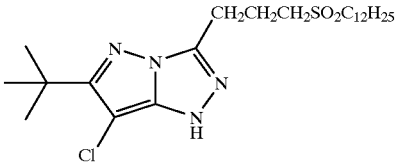

M-8:

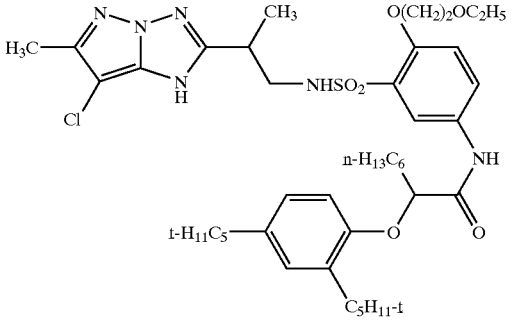

M-9:

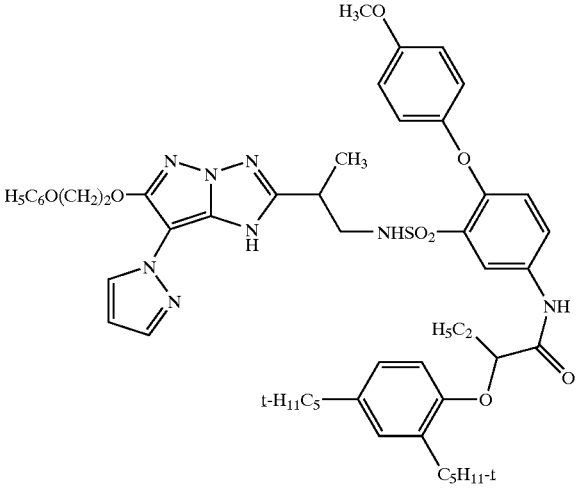

M-10:

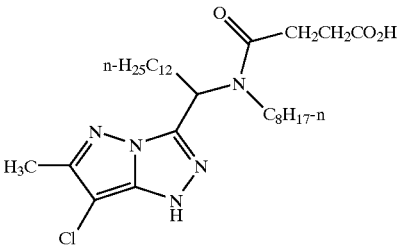

M-11:

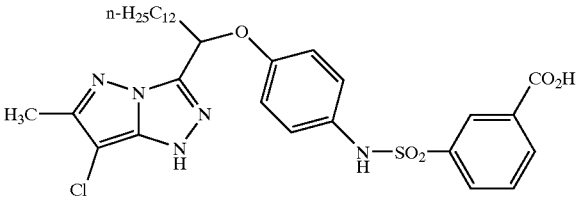

-continued

M-12:

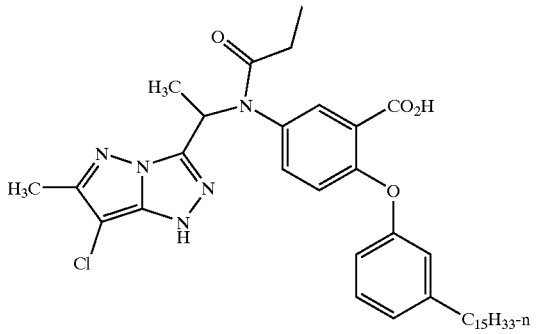

For the purposes of this invention, it is highly desirable to maximize the reactivity of the two equivalent magenta couplers towards oxidized developer. In particular, it is preferred that the two equivalent 5-pyrazolone couplers are dispersed in at least its own weight in a permanent solvent and optionally may contain an additional aniline or nitrogen heterocycle to minimize bleach induced density formation (as known as continued coupling) as known in the art. Some examples of suitable permanent solvents for either class of magenta coupler are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Preferred classes of solvents are carbonamides, phosphates, alcohols and esters. The laydown of the magenta image coupler is not critical but will depend on the activity and type of coupler. It is understood that the laydown should be suitable to obtain the desired density and speed, but for most applications, the laydown will not exceed 0.4 mmoles/$m^2$. Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the layers containing the magenta coupler of the invention additionally contain less than a stoichiometric amount of total dye forming coupler(s) relative to the amount of silver contained in the same layer. A suitable molar ratio of dye-forming coupler(s) to silver in the layer containing the dye layered emulsion would be less than 0.5. More preferred would be a ratio of 0.1 or less and most preferred would be a ratio of 0.05 or less.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. Particularly useful is a silver halide photographic element wherein the silver halide photographic element further comprises a yellow filter dye in a layer between the support and the green sensitized layer closest to the support. A preferred dye is show below.

YFD-1

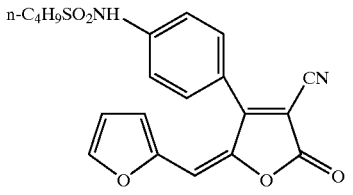

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments. A particularly useful support for small format film is annealed polyethylenenaphthlate.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e., color negative, reversal, or direct positive processing) provided with the element. More preferably the elements are negative working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755 A and 2,017,704 A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkcuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publication GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

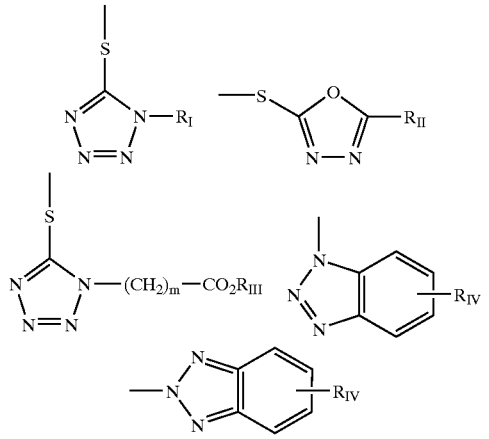

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

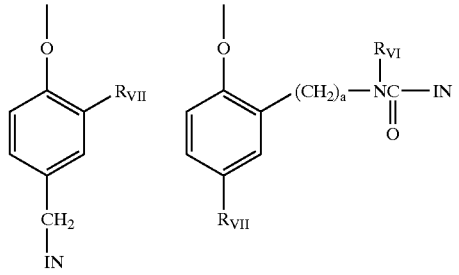

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

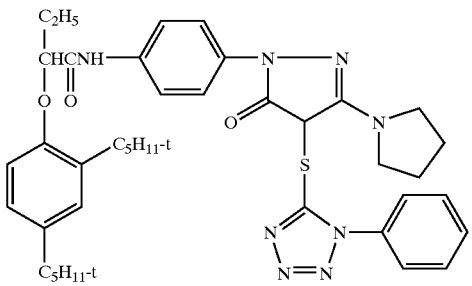

D2

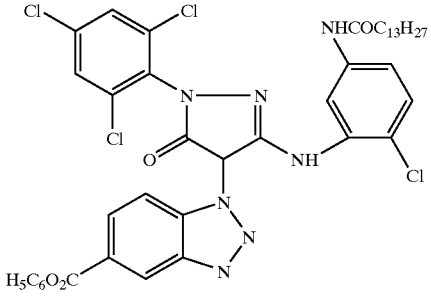

-continued
D3
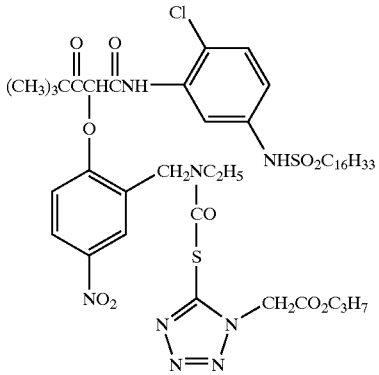
D4
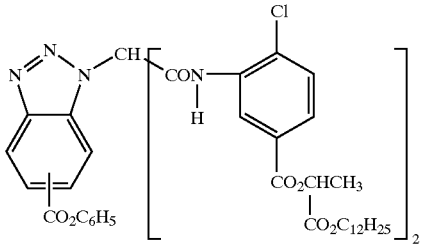
D5
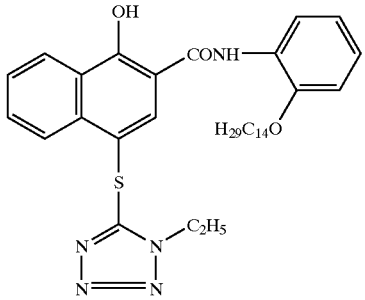
D6
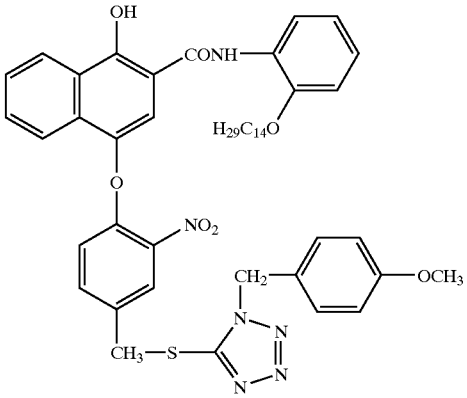
-continued
D7
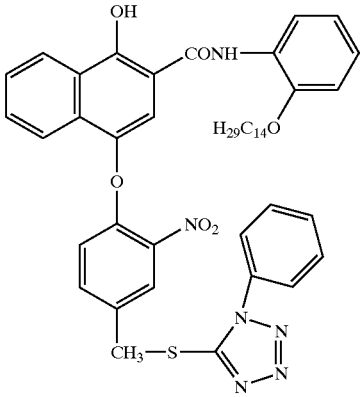
D8
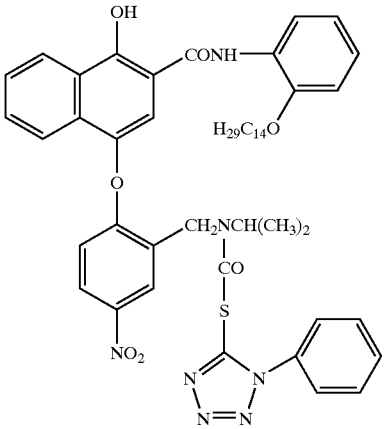
D9
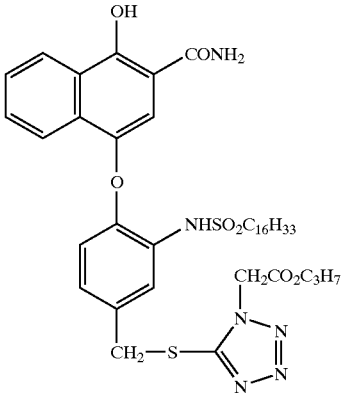

-continued

D10

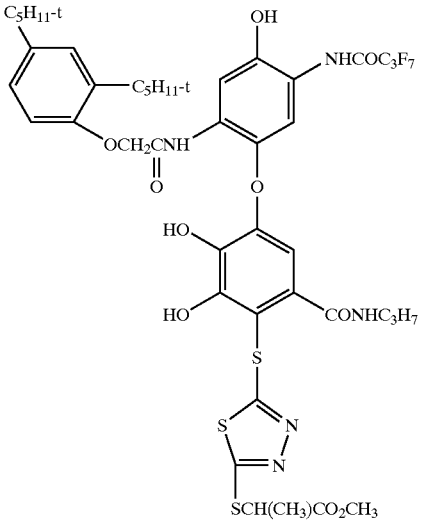

D11

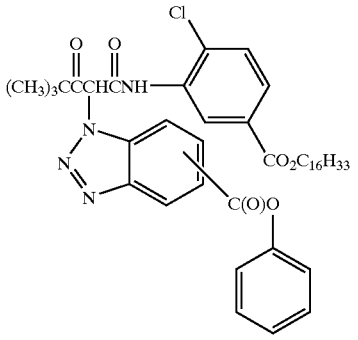

D12

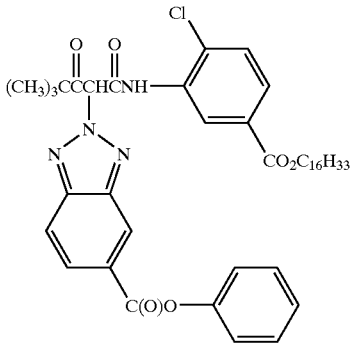

The silver halide used in the photographic elements may be silver iodobromide, silver bromide, silver chloride, silver chlorobromide, silver chloroiodobromide, and the like. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains. Preferably the dye layered silver halide emulsion has an average ECD grain size of less than 1.3 $\mu$m, and more preferably the dye layered silver halide emulsion has an average ECD grain size of less than 1.1 $\mu$m.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 $\mu$m. Most preferably the average thickness of the tabular grains is less than 0.2 $\mu$m. In a specific preferred form the tabular grains are ultrathin—that is, their average thickness is less than 0.07 $\mu$m.

The useful average grain ECD of a tabular grain emulsion can range up to about 15 $\mu$m. Except for a very few high speed applications, the average grain-ECD of a tabular grain emulsion is conventionally less than 10 $\mu$m, with the average grain ECD for most tabular grain emulsions being less than 5 $\mu$m.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, Maskasky et al U.S. Pat. Nos. 5,176,992 and 5,178,998, Takada et al U.S. Pat. No. 4,783,398, Nishikawa et al U.S. Pat. No. 4,952,508, Ishiguro et al U.S. Pat. No. 4,983,508, Tufano et al U.S. Pat. No. 4,804,621, Maskasky and Chang U.S. Pat. No. 5,178,998, and Chang et al U.S. Pat. No. 5,252,452. Ultrathin high chloride {111} tabular grain emulsions are illustrated by Maskasky U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992, 5,221,602, 5,298,387 and 5,298,388, the disclosures of which are here incorporated by reference.

Preferred high chloride tabular grain emulsions are {100} tabular grain emulsions, as illustrated by the following patents, here incorporated by reference: Maskasky U.S. Pat. Nos. 5,264,337, 5,292,632, 5,275,930, 5,607,828 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904, 5,663,041, and 5,744,297, Budz et al U.S. Pat. No. 5,451,490, Reed et al U.S. Pat. No. 5,695,922, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 4,173,320 and 5,411,851 5,418,125, 5,492,801, 5,604,085, 5,620,840, 5,693,459, 5,733,718, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S, Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175, 5,612,176 and 5,614,359, and Irving et al U.S. Pat. Nos. 5,695,923, 5,728,515 and 5,667,954, Bell et al U.S. Pat. No. 5,132,203, Brust U.S. Pat. Nos. 5,248,587 and 5,763,151, Chaffee et al U.S. Pat. No. 5,358,840, Deaton et al U.S. Pat. No. 5,726,007, King et al U.S. Pat. No. 5,518,872, Levy et al U.S. Pat. No. 5,612,177, Mignot et al U.S. Pat. No. 5,484,697, Olm et al U.S. Pat. No. 5,576,172, Reed et al U.S. Pat. Nos. 5,604,086 and 5,698,387.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure*, Item 38957, Section 1. Emulsion grains and their preparation, sub-section G. Grain modifying conditions and adjustments, paragraphs (3), (4) and (5), can be present in the emulsions of the invention. Especially useful dopants are disclosed by Marchetti, et al., U.S. Pat. No. 4,937,180, and Johnson, et al., U.S. Pat. No. 5,164,292. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference.

SET dopants are known to be effective to reduce reciprocity failure. In particular the use of $Ir^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in *The British Journal of Photoraphy Annual* of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications cited in this specification are incorporated herein by reference. The following example is intended to illustrate, but not to limit the invention.

EXAMPLES

Multilayer films demonstrating the principles of this invention were produced by coating the following layers on cellulose triacetate film base which contained a RemJet carbon antihalation layer on the side opposing the emulsion layers. Coverages are in grams per meter squared, emulsion sizes as determined by the disc centrifuge method and are reported in Diameter×Thickness in micrometers. Surfactants, coating aids, emulsion addenda (including 4-hydroxy-6-methyl-1,3,3a,7-tetraazaindene), sequestrants, thickeners, lubricants, matte, filter dyes and tinting dyes were added to the appropriate layers as is common in the art.

Multilayer Sample 100:

Layer 1 (Slow Cyan Layer): a red sensitized (all with a mixture of RSD-100 and RSD-200) tabular silver iodobromide emulsion (0.92×0.11 μm, 2.4 mole % iodide) at 0.861, cyan dye-forming coupler C-100 at 0.517; bleach accelerator releasing coupler B-100 at 0.069; image modifiers DIR-100 at 0.086; masking coupler MC-100 at 0.011 and gelatin at 1.79.

Layer 2 (Mid Cyan Layer): a red sensitized (with a mixture of RSD-100 and RSD-200) iodobromide tabular emulsion (1.2×0.13 μm, 3.7 mole % I) at 0.872; cyan dye forming coupler C-100 at 0.078; bleach accelerator releasing coupler B-100 at 0.019; DIR-100 at 0.006 and gelatin at 1.12.

Layer 3 (Fast Cyan Layer): a red sensitized (with a mixture of RSD-100 and RSD-200) iodobromide tabular emulsion (2.18×0.122 μm, 4.5 mole % I) at 1.07; cyan dye forming coupler C-1 at 0.055; DIR-2 at 0.011; bleach accelerator releasing coupler B-1 at 0.044; development promoting agent SIC-100 at 0.017; masking coupler MC-100 at 0.016 and gelatin at 1.35.

Layer 4 (NIL-Interlayer): ILS-100 at 0.108; Dye-200 at 0.009; Dye-500 at 0.032 and gelatin at 0.914.

Layer 5 (Slow Magenta Layer): a green sensitized (with a mixture of GSD-100 and GSD-20( )0) silver iodobromide tabular Emulsion A (0.55×0.12 μm, 3.0 mole % iodide) at 0.699; magenta dye forming coupler M-300 at 0.414; masking coupler MC-200 at 0.108 and gelatin at 0.915.

Layer 6 (Mid Magenta Layer): a blend of two green sensitized (both with a mixture of GSD-100 and GSD-200) (i) Emulsion B (0.78×0.12 μm silver bromoiodide, 4.5 mole % iodide) at 0.334, (i) silver iodobromide tabular Emulsion C (1.39×0.131 μm, 4.5 mole % iodide) at 0.581; and magenta dye forming coupler M-300 at 0.220; masking coupler MC-200 at 0.054; DIR-400 at 0.013, DIR-100 at 0.016, and gelatin at 1.29.

Layer 7 (Fast Magenta Layer): a green sensitized (with a mixture of GSD-100 and GSD-200) silver iodobromide tabular Emulsion D (2.29×0.128 μm, 3.7 mole % iodide) at 0.883; magenta dye forming coupler M-100 at 0.042; masking coupler MC-200 at 0.022; development promoting agent SIC-100 at 0.022 and gelatin at 1.29.

Layer 8 (NIL-Interlayer): ILS-100 at 0.108; DYE-500 at 0.027, Microcrystalline Yellow Filter DYE-400 at 0.151 and gelatin at 0.592.

Layer 9 (Slow Yellow Layer): a blend of two blue sensitized (all with BSD-100) tabular silver iodobromide emulsions (i) 1.5×0.13 μm, 4.0 mole % iodide at 0.161, (ii) 0.70×0.13 μm, 3.0 mole % iodide at 0.409; yellow dye forming coupler Y-1010 at 0.474; DIR-5 at 0.043 and gelatin at 1.13.

Layer 10 (Mid Yellow Layer): a blue sensitized (with BSD-100) tabular silver iodobromide emulsions (1.5×0.13 μm, 4.0 mole % iodide) at 0.646; yellow dye forming coupler Y-1 at 0.133; DIR-500 at 0.003 and gelatin at 1.00.

Layer 11 (Fast Yellow Layer): a blue sensitized (with BSD-1) 3 dimensional silver iodobromide emulsion (1.7 μm, 10.5 mole % iodide) at 1.54; yellow image coupler Y-100 at 0.076; yellow image coupler Y-200 at 0.208 and gelatin at 1.98.

Layer 12 (NIL-UV Layer): silver bromide Lippman emulsion at 0.215; UV-100 at 0.114, UV-2( ) at 0.022 and gelatin at 0.861.

Layer 13 (NIL-Protective Overcoat): gelatin at 0.872 and bis(vinylsulfonyl)methane hardener at 1.6% of total gelatin weight.

Multilayer Samples 101 was like Multilayer Sample 200 except Emulsion E was used in Fast Magenta Layers 7 as described in Table I.

Multilayer Sample 200:

Layer 1 (Slow Cyan Layer): a red sensitized (all with a mixture of RSD-100 and RSD-200) tabular silver iodobromide emulsion (0.90×0.11 μm, 2.4 mole % iodide) at 0.699, cyan dye-forming coupler C-100 at 0.194; bleach accelerator releasing coupler B-100 at 0.097; image modifiers DIR-100 at 0.045; masking coupler MC-100 at 0.011 and gelatin at 1.70.

Layer 2 (Mid Cyan Layer): a red sensitized (with a mixture of RSD-100 and RSD-200) iodobromide tabular emulsion (1.16×0.124 μm, 3.7 mole % I) at 0.968; cyan dye forming coupler C-100 at 0.072; bleach accelerator releasing coupler B-100 at 0.026; DIR-100 at 0.038, yellow image dye forming coupler Y-200 at 0.043 and gelatin at 1.40.

Layer 3 (Fast Cyan Layer): a red sensitized (with a mixture of RSD-100 and RSD-200) iodobromide tabular emulsion (2.18×0.122 am, 4.5 mole % I) at 0.807; cyan dye forming coupler C-100 at 0.072; DIR-2 at 0.010; bleach accelerator releasing coupler B-100 at 0.045; yellow image dye forming coupler Y-200 at 0.011; development promoting agent SIC-00 at 0.016; masking coupler MC-100 at 0.01 land gelatin at 1.29.

Layer 4 (NIL-Interlayer): ILS-100 at 0.043; Dye-200 at 0.011; Dye-300 at 0.011 and gelatin at 0.915.

Layer 5 (Slow Magenta Layer): a green sensitized (with a mixture of GSD-100 and GSD-200) silver iodobromide tabular Emulsion A (0.55×0.12 μm, 3.0 mole % iodide) at 0.592; magenta dye forming coupler M-100 at 0.011; magenta dye forming coupler M-300 at 0.215; masking coupler MC-200 at 0.129 and gelatin at 0.915.

Layer 6 (Mid Magenta Layer): a green sensitized (with a mixture of GSD-100 and GSD-200) silver iodobromide tabular Emulsion F (1.30×0.128 μm, 3.0 mole % iodide) at 0.968; magenta dye forming coupler M-200 at 0.088; masking coupler MC-200 at 0.048; DIR-300 at 0.029 and gelatin at 1.21.

Layer 7 (Fast Magenta Layer): a green sensitized (with a mixture of GSD-100 and GSD-200) silver iodobromide tabular Emulsion J (2.5×0.127 μm, 4.5 mole % iodide) at 0.861; magenta dye forming coupler M-100 at 0.033; magenta dye forming coupler M-300 at 0.027; masking coupler MC-200 at 0.019; DIR-400 at 0.002; development promoting agent SIC-100 at 0.022 and gelatin at 1.18.

Layer 8 (NIL-Interlayer): ILS-100 at 0.022; DYE-300 at 0.022, Microcrystalline Yellow Filter DYE-400 at 0.086 and gelatin at 0.592.

Layer 9 (Slow Yellow Layer): a blend of three blue sensitized (all with BSD-1) tabular silver iodobromide emulsions (i) 2.61×0.13 μm, 4.0 mole % iodide at 0.626, (ii) 1.5×0.13 μm, 4.0 mole % iodide at 0.136, (iii) 0.70×0.13 μm, 4.0 mole % iodide at 0.115; yellow dye forming coupler Y-100 at 0.628; DIR-500 at 0.032 and gelatin at 1.59.

Layer 10 (Fast Yellow Layer): a blend of two blue sensitized (all with BSD-100) (i) 3 dimensional silver iodobromide emulsion (1.71 μm, 10.5 mole % iodide) at 0.1.075, (ii) tabular silver iodobromide emulsion (2.6×0.13 μm, 4.0 mole % iodide) at 0.215; yellow image coupler Y-200 at 0.153; yellow image coupler Y-300 at 0.056; S-100 at 0.183; fragmentable electron donor FED-100 at 0.001 and gelatin at 1.62.

Layer 11 (NIL-UV Layer): silver bromide Lippman emulsion at 0.215; UV-100 at 0.108, UV-200 at 0.022 and gelatin at 0.861.

Layer 12 (NIL-Protective Overcoat): gelatin at 0.873 and bis(vinylsulfonyl)methane hardener at 1.6% of total gelatin weight.

Multilayer Samples 201 TO 205: were like Multilayer Sample 200 except emulsion changes to Layers 5 and 6 as described in Table II. A description of the emulsions used in Layers 5, 6 and 7 of the above multilayer samples are as follows:

Emulsion A:

A 0.55×0.12 μm silver bromoiodide (overall iodide content 3.0%) tabular grain emulsion was prepared by the following method. This example is a scaled up version of the following emulsion. To a 4.6 liter aqueous solution containing 0.4 weight percent oxidized bone gelatin and 7.02 g/L sodium bromide at 44.5° C. with vigorous stirring in the reaction vessel was added by single jet addition of 0.84 M silver nitrate solution at constant flow rate over a 7.5-minute period, consuming 1.71% of total silver. After a 1 minute hold the 0.84 M silver nitrate solution and a 3.0 M sodium bromide solution were added over a 7.5 minute period while controlling pBr at 1.83 consuming another 3.2% of the total silver. Subsequently, an aqueous solution containing 10.16 g of ammonium sulfate solution was added to the vessel, followed by the addition of 74.74 ml of sodium hydroxide at 2.5 M. After 5 min, 46.3 mL nitric acid at 4.0 M was added. Then 2.4 liters of an aqueous solution containing 9.2% gelatin by weight and 40° C. was added to the reaction vessel and held for 3 minutes. Then the 0.84 M silver nitrate solution was added by single jet addition over a 2.6 minute period consuming 3.87% of the total silver. Then an aqueous 3.0M silver nitrate solution and an aqueous solution of 2.99M sodium bromide were added by double jet methods simultaneously to the reaction vessel utilizing accelerated flow rate over 46 minutes while controlling pBr at 2.45 consuming 69.6 mole percent of the total silver. At 44.5 minutes into this segment, 50 mppm of tetrapotassium hexacyanoruthenate (K 4 Ru(CN) 6) was added to the reaction vessel. After the accelerated flow segment, both silver and salt solutions were halted, 250 ml of a solution containing 0.885 mg potassium selenocyanate and 9.14 g of potassium bromide was added. After two minutes the pBr of the vessel was adjusted to 1.16 by addition of the sodium bromide salt. Silver iodide Lippmann seed at 3 percent of total silver was then added to the reaction vessel. After a two-minute halt, a 3.0 M silver nitrate solution was added to bring the pBr to 2.51. Then a 3.0 M sodium bromide solution was added simultaneously with the silver nitrate solution to the reaction vessel to control pBr at 2.67 until a total of 12.92 moles of silver halide was prepared. The emulsion was cooled to 40° C. and washed by ultrafiltration methods. The emulsion was heated to 43° C. and sodium thiocyanate (125 mg/Ag mole) was added and after a 10' hold the finish modifier benzothiazolium,3-(3-((methylsulfonyl)amino)-3-oxopropyl)-,tetrafluoroborate(1-) (36 mg/Ag mole) was added. After a 2 minute hold, the first sensitizing dye, GSD-200 (560 mg/Ag mole) was added. After a 10' hold the second sensitizing dye GSD-100 (101 mg/Ag mole). After an additional 20 minute hold, a sulfur/gold salt source aurate(3-), bis(monothiosulfato(2)—O,S)—, trisodium dihydrate, (T-4)-(3.0 mg/Ag mole) was added and held for 2 additional minutes. A second sulfur agent thiosulfuric acid (H2S203), disodium salt (1.51 mg/Ag mole) was added. After an additional 2 minute hold, the melt was heated to 65° C. for 16.5 minutes. After cooling to 40° C., tetraazaindine (500 mg/Ag mole) was added.

Emulsion B:

A 0.78×0.12 μm silver bromoiodide (overall iodide content 4.5%) tabular grain emulsion was prepared by the following method: This example is a scaled up version of the following emulsion. To a 4.6 liter aqueous solution containing 0.4 weight percent oxidized bone gelatin and 7.02 g/L sodium bromide at 38° C. with vigorous stirring in the reaction vessel was added by single jet addition of 0.42 M silver nitrate solution at constant flow rate over a 7.5-minute period, consuming 1.77% of total silver. Subsequently, an aqueous solution containing 19.8 g of ammonium sulfate solution was added to the vessel, followed by the addition of 136.3 ml of sodium hydroxide at 2.5 M. After 5 min, 83.89 mL nitric acid at 4.0 M was added. Then 2.4 liters of an aqueous solution containing 9.5% gelatin by weight and 40° C. was added to the reaction vessel and held for 5 minutes. Then an aqueous 3.0M silver nitrate solution and an aqueous solution of 2.99M sodium bromide were added by double jet methods simultaneously to the reaction vessel utilizing accelerated flow rate over 45.9 minutes while controlling pBr at 2.06 consuming 69.1 mole percent of the total silver. At 43.9 minutes into this segment, 50 mppm of tetrapotassium hexacyanoruthenate (K 4 Ru(CN) 6) was added to the reaction vessel. After the accelerated flow segment, both silver and salt solutions were halted, 250 ml of a solution containing 0.848 mg potassium selenocyanate was added. After two minutes the pBr of the vessel was adjusted to 1.16 by addition of sodium bromide salt. Silver iodide Lippmann seed at 4.5 percent of total silver was then added to the reaction vessel. After a two-minute halt, a 3.0 M silver nitrate solution was added to bring the pBr to 2.6. Then a 3.0 M sodium bromide solution was added simultaneously with the silver nitrate solution to the reaction vessel to control pBr at 2.75 until a total of 12.45 moles of silver halide was prepared. The emulsion was cooled to 40° C. and washed by ultrafiltration methods. The emulsion was heated to 43° C. and sodium thiocyanate (100 mg/Ag mole) was added and after a 10' bold the finish modifier benzothiazolium,3-(3-((methylsulfonyl)amino)-3-oxopropyl)-, tetrafluoroborate (1-) (35 mg/Ag mole) was added. After a 2 minute hold, the first sensitizing dye, GSD-200 (657 mg/Ag mole) was added. After a 10' hold the second sensitizing dye, GSD-100 (119 mg/Ag mole). After an additional 20 minute hold, a sulfur/gold salt source aurate(3-),bis(monothiosulfato(2)-O,S)—, trisodium dihydrate, (T-4)-(3.2 mg/Ag mole) was added and held for 2 minutes. A second sulfur agent thiosulfuric acid (H2S203), disodium salt (1.52 mg/Ag mole) was added. After an additional 2 minute hold, the melt was heated to 60° C. for 24 minutes. After cooling to 40° C., tetraazaindine (500 mg/Ag mole) was added.

Emulsion C

A 1.35×0.132 μm silver bromoiodide (overall iodide content 4.5%) tabular grain emulsion was prepared exactly like Emulsion G except the precipitation reaction temperature was increased to 44.0 C, ammonium sulfate, sodium hydroxide and nitric acid levels was increased by 3.5% growth pBr was controlled at 1.75, and the silver iodide Lippmann seed was increased to 4.5 percent of total silver. The emulsion was heated to 43° C. and sodium thiocyanate (100 mg/Ag mole) was added and after a 10' hold the finish modifier benzothiazolium,3-(3-((methylsulfonyl)amino)-3-oxopropyl)-,tetrafluoroborate(1-) (35 mg/Ag mole) was added. After a 2 minute hold, the first sensitizing dye, GSD-200 (538 mg/Ag mole) was added. After a 10' hold the second sensitizing dye, GSD-100 (95 mg/Ag mole). After an additional 20 minute hold, a sulfur/gold salt source aurate (3-), bis(monothiosulfato(2)—O,S)—, trisodium dihydrate, (T-4)-(2.465 mg/Ag mole) was added and held for 2 additional minutes. A second sulfur agent thiosulfuric acid (H2S203), disodium salt (1.2 mg/Ag mole) was added. After an additional 2 minute hold, the melt was heated to 62.22° C. for 16.5 minutes. After cooling to 40° C., tetraazaindine (500 mg/Ag mole) was added.

Emulsion D

A 2.25×0.125 μm silver bromoiodide (overall iodide content 3.7%) tabular grain emulsion was prepared exactly like Emulsion G except the precipitation reaction temperature was increased to 61.0 C., ammonium sulfate, sodium hydroxide and nitric acid levels was decreased by 30% growth pBr was controlled at 1.74, and the silver iodide Lippmann seed was increased to 3.7 percent of total silver. The emulsion was heated to 43° C. and sodium thiocyanate (100 mg/Ag mole) was added and after a 10' hold the finish modifier benzothiazolium, 3-(3-((methylsulfonyl)amino)-3-oxopropyl)-, tetrafluoroborate(1-) (35 mg/Ag mole) was added. After a 2 minute hold, the first sensitizing dye, GSD-200 (462 mg/Ag mole) was added. After a 10' hold the second sensitizing dye, GSD-100 (88.5 mg/Ag mole). After an additional 20 minute hold, a sulfur/gold salt source aurate(3-),bis(monothiosulfato(2)-O,S)—, trisodium dihydrate, (T-4)-(2.01 mg/Ag mole) was added and held for 2 additional minutes. A second sulfur agent thiosulfuric acid (H2S203), disodium salt (0.93 mg/Ag mole) was added. After an additional 2 minute hold, the melt was heated to 60° C. for 23 minutes. After cooling to 40° C., tetraazaindine (500 mg/Ag mole) was added.

Emulsion E

Emulsion E was prepared exactly like Emulsion D except omitting the tetraazaindine and adding acetamide, N-(3-(2,5-dihydro-5 thioxo-1H-tetrazol-1-yl)phenyl)-(16 mg/Ag mole). After a 2 minute hold a third sensitizing dye GSD-300 (801.6 mg/Ag mole) was added. After a 10 minute hold, benzenesulfonic acid, 2,5-dihydroxy-4-(1-methylheptadecyl-,monosodium salt was added (250 mg/Ag mole). After a 2 minute hold, butanedioic acid, sulfo-,1,4-bis(2-ethylhexyl) ester, sodium salt (1500 mg/mole) was added. After another 2 minute hold, tetraazaindine (500 mg/Ag mole) was added.

Emulsion F:

A 1.3×0.128 μm silver bromoiodide (overall iodide content 3%) tabular grain emulsion was prepared exactly like Emulsion G except the precipitation reaction temperature was increased to 45° C., ammonium sulfate, sodium hydroxide and nitric acid levels was decreased by 7% and the growth pBr was controlled at 1.78. The emulsion was heated to 43° C. and sodium thiocyanate (100 mg/Ag mole) was added and after a 10' hold the finish modifier benzothiazolium,3-(3-((methylsulfonyl)amino)-3-oxopropyl)-, tetrafluoroborate(1-) (35 mg/Ag mole) was added. After a 2 minute hold, the first sensitizing dye, GSD-200 (506 mg/Ag mole) was added. After a 10' hold the second sensitizing dye, GSD-100 (97.5 mg/Ag mole). After an additional 20 minute hold, a sulfur/gold salt source aurate(3-), bis(monothiosulfato(2)-O,S)—, trisodium dihydrate, (T-4)-(1.76 mg/Ag mole) was added and held for 2 additional minutes. A second sulfur agent thiosulfuric acid (H2S203), disodium salt (0.824 mg/Ag mole) was added. After an additional 2 minute hold, the melt was heated to 62.5° C. for 17 minutes. After cooling to 40° C., tetraazaindine (500 mg/Ag mole) was added.

Emulsion G:

A 1.16×0.123 μm silver bromoiodide (overall iodide content 3%) tabular grain emulsion was prepared by the following method. This example is a scaled up version of the following emulsion. To a 4.6 liter aqueous solution containing 0.4 weight percent oxidized bone gelatin and 7.02 g/L sodium bromide at 39.5° C. with vigorous stirring in the reaction vessel was added by single jet addition of 0.42 M silver nitrate solution at constant flow rate over a 15-minute period, consuming 1.77% of total silver. Subsequently, an aqueous solution containing 28.6 g of ammonium sulfate solution was added to the vessel, followed by the addition of 195.6 ml of sodium hydroxide at 2.5 M. After 5 min, 122.69 mL nitric acid at 4.0 M was added. Then 1.98 liters of an aqueous solution containing 10.92% gelatin by weight and 40° C. was added to the reaction vessel. After a 5-minute hold, a solution of 3.0 M sodium bromide was added a by single jet over a 1-minute period adjusting the pBr to 1.72. Then an aqueous 3.0M silver nitrate solution and an aqueous solution of 2.99M sodium bromide were added by double jet methods simultaneously to the reaction vessel utilizing accelerated flow rate over 45.9 minutes while controlling pBr at 1.72 consuming 69.1 mole percent of the total silver. At 43.9 minutes into this segment, 50 mppm of tetrapotassium hexacyanoruthenate (K 4 Ru(CN) 6) was added to the reaction vessel. After the accelerated flow segment, both silver and salt solutions were halted, 250 ml of a solution containing 0.848 mg potassium selenocyanate was added. After two minutes the pBr of the vessel was adjusted to 1.07 by addition of sodium bromide salt. Silver iodide Lippmann seed at 3.0 percent of total silver was then added to the reaction vessel. After a two-minute halt, a 3.0 M silver nitrate solution was added to bring the pBr to 2.66. Then a 3.0 M sodium bromide solution was added simultaneously with the silver nitrate solution to the reaction vessel to control pBr at 3.14 until a total of 12.45 moles of silver halide was prepared. The emulsion was cooled to 40° C. and washed by ultrafiltration methods. The emulsion was heated to 43° C. and sodium thiocyanate (150 mg/Ag mole) was added and after a 10' hold the finish modifier benzothiazolium,3-(3-((methylsulfonyl)amino)-3-oxopropyl)-, tetrafluoroborate(1-) (35 mg/Ag mole) was added. After a 2 minute hold, the first sensitizing dye, GSD-200 (506 mg/Ag mole) was added. After a 10' hold the second sensitizing dye, GSD-100 (97.5 mg/Ag mole). After an additional 20 minute hold, a sulfur/gold salt source aurate(3-), bis(monothiosulfato(2)-O,S)—, trisodium dihydrate, (T-4)-(2.20 mg/Ag mole) was added and held for 2 additional minutes. A second sulfur agent thiosulfuric acid (H2S203), disodium salt (1.03 mg/Ag mole) was added. After an additional 2 minute hold, the melt was heated to 62.5° C. for 15 minutes. After cooling to 40° C., tetraazaindine (500 mg/Ag mole) was added.

Emulsion H:

Emulsion H was prepared exactly like Emulsion G except omitting the tetraazaindine and adding acetamide, N-(3-(2,5-dihydro-5 thioxo-1H-tetrazol-1-yl)phenyl)-(16 mg/Ag mole). After a 2 minute hold a third sensitizing dye GSD-300 (801.6 mg/Ag mole) was added. After a 10 minute hold, benzenesulfonic acid, 2,5-dihydroxy-4-(1-methylheptadecyl-,monosodium salt was added (250 mg/Ag mole). After a 2 minute hold, butanedioic acid, sulfo-,1,4-bis(2-ethylhexyl) ester, sodium salt (1500 mg/mole) was added. After another 2 minute hold, tetraazaindine (500 mg/Ag mole) was added.

Emulsion I:

This emulsion was prepared exactly like Emulsion A except omitting the tetraazaindine and ading acetamide, N-(3-(2,5-dihydro-5 thioxo-1H-tetrazol-1-yl)phenyl)-(16 mg/Ag mole). After a 2 minute hold a third sensitizing dye GSD-300 (1069 mg/Ag mole) was added. After a 10 minute hold, benzenesulfonic acid, 2,5-dihydroxy-4-(1-methylheptadecyl-,monosodium salt(250 mg/Ag mole) was added and held for 2 minutes. Then butanedioic acid, sulfo-, 1,4-bis(2-ethylhexyl) ester, sodium salt (1500 mg/mole) was added. After another 2-minute hold, tetraazaindine (500 mg/Ag mole) was added.

Emulsion J:

A 2.5×0.127 $\mu$m silver bromoiodide (overall iodide content 4.5%) tabular grain emulsion was prepared exactly like Emulsion G except the precipitation reaction temperature was increased to 64.5 C., ammonium sulfate, sodium hydroxide and nitric acid levels was decreased by 42% growth pBr was controlled at 1.74, and the silver iodide Lippmann seed was increased to 4.5 percent of total silver. The emulsion was heated to 43° C. and sodium thiocyanate (100 mg/Ag mole) was added and after a 10' hold the finish modifier benzothiazolium,3-(3-((methylsulfonyl)amino)-3-oxopropyl)-, tetrafluoroborate(1-) (35 mg/Ag mole) was added. After a 2 minute hold, the first sensitizing dye, GSD-200 (462 mg/Ag mole) was added. After a 10' hold the second sensitizing dye, GSD-100 (88.5 mg/Ag mole). After an additional 20 minute hold, a sulfur/gold salt source aurate(3-),bis(monothiosulfato(2)-O,S)—, trisodium dihydrate, (T-4)-(2.01 mg/Ag mole) was added and held for 2 additional minutes. A second sulfur agent thiosulfuric acid (H2S203), disodium salt (0.93 mg/Ag mole) was added. After an additional 2 minute hold, the melt was heated to 60° C. for 31 minutes. After cooling to 40° C., tetraazaindine (500 mg/Ag mole) was added.

Chemical formulas for materials used in the above multilayer samples are as follows:

ILS-100:

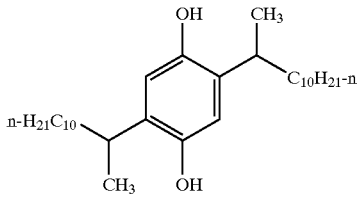

DYE-100:

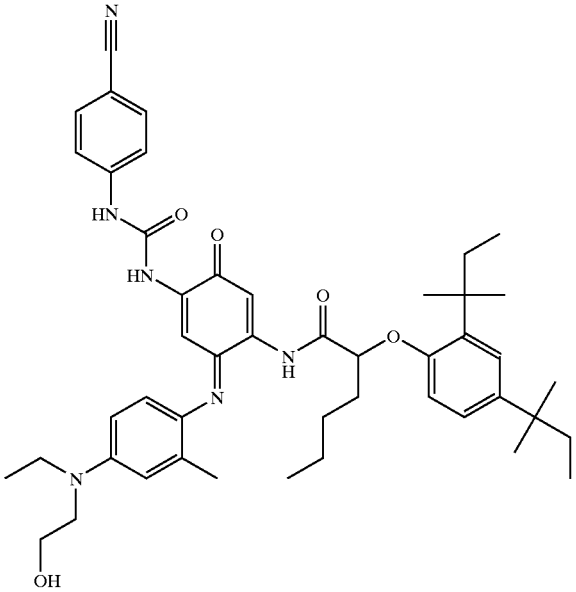

DYE-200:

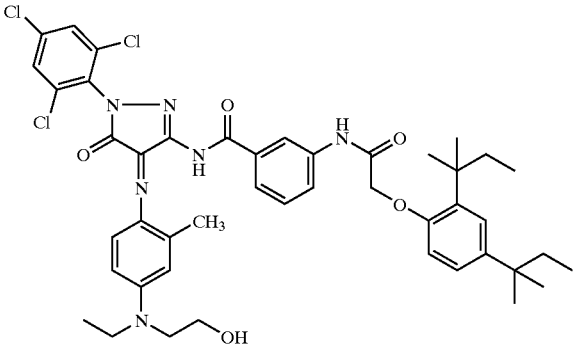

DYE-300:

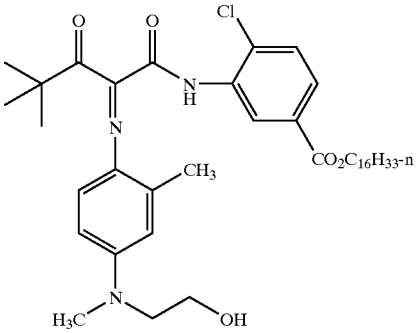

-continued
DYE-400:
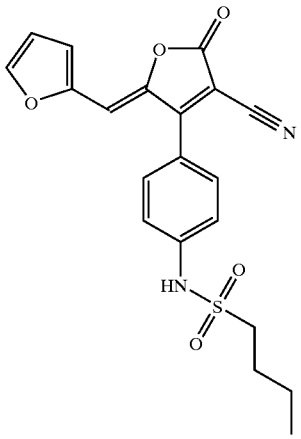
DYE-500:
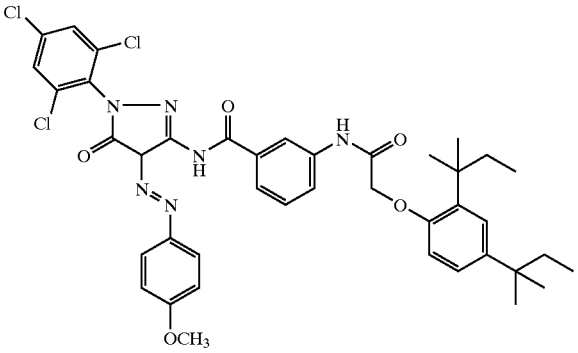
UV-100:
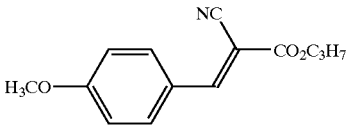
UV-200:
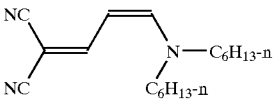
SIC-100:
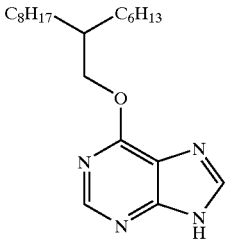
-continued
C-100:
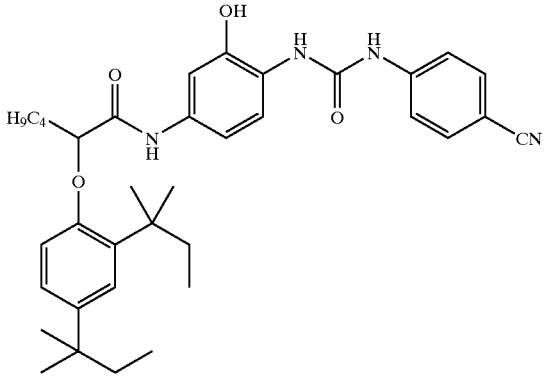
B-100:
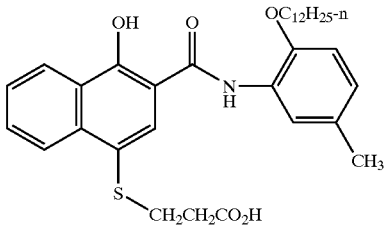
DIR-100:
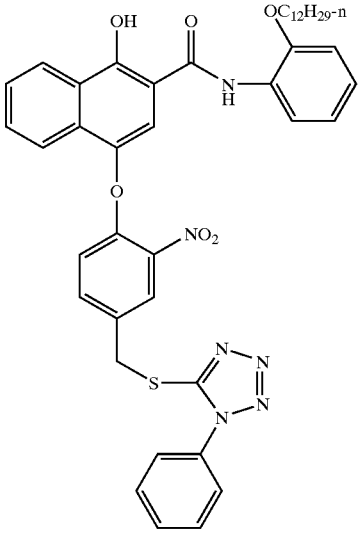
DIR-200:
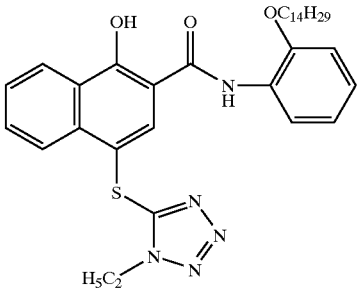

-continued
MC-100:
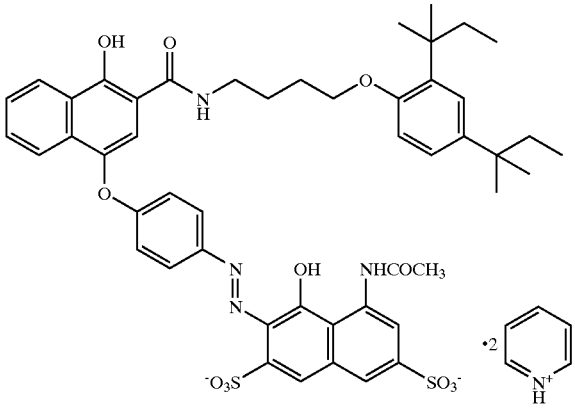
M-100:
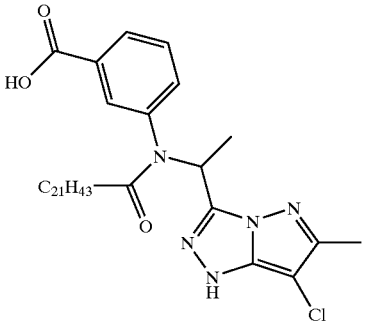
M-200:
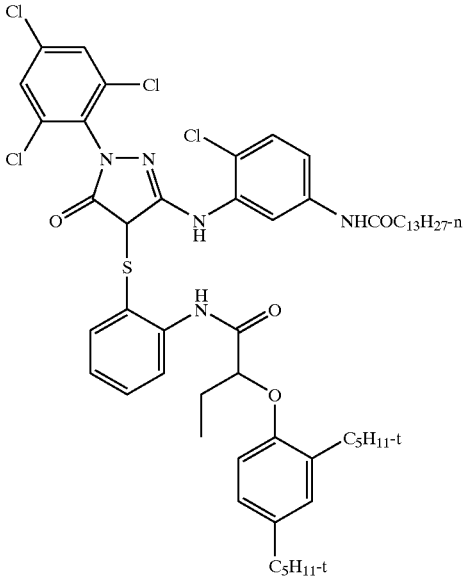
-continued
M-300:
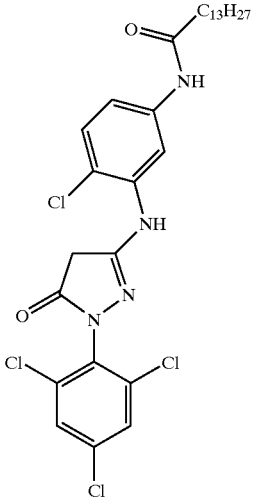
DIR-300:
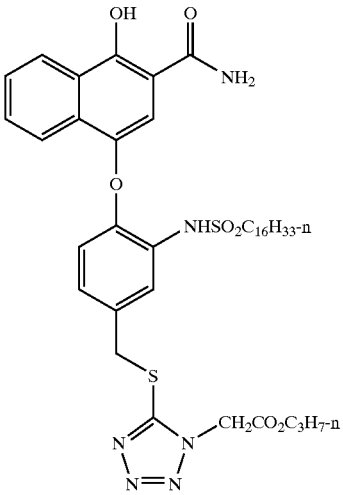
DIR-400:
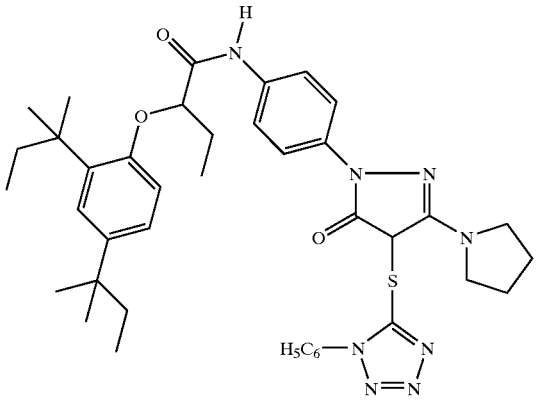

-continued
MC-200:
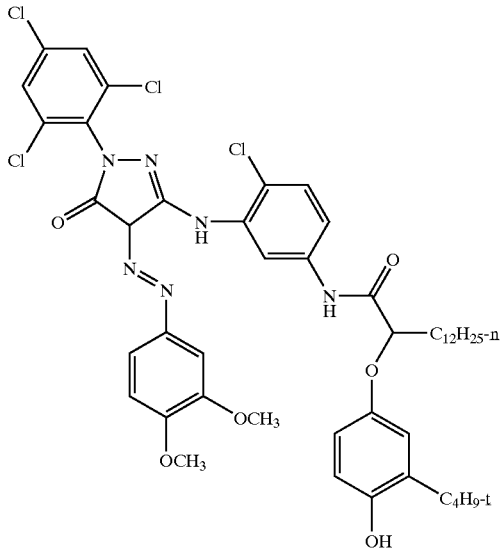
Y-100:
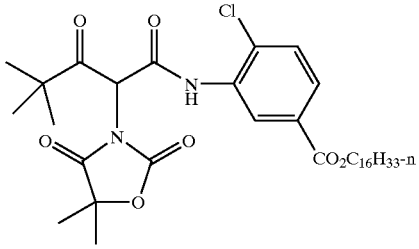
Y-200:
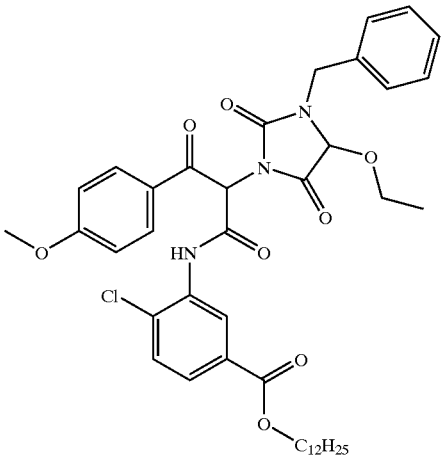
-continued
Y-300:
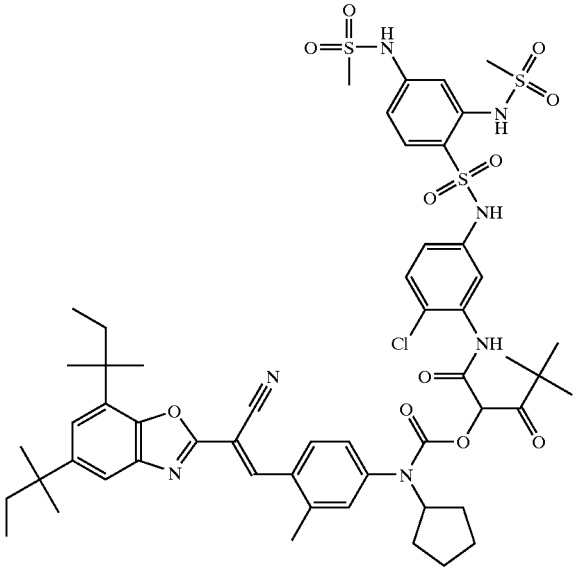
DIR-500:
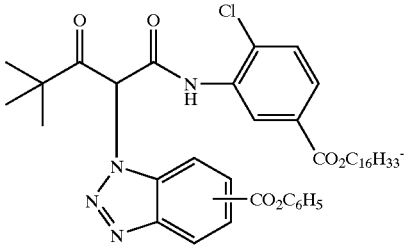
FED-100:
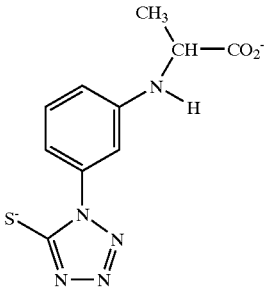
S-100:
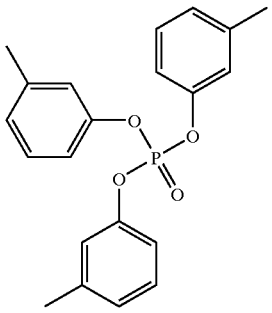

-continued

BSD-100:

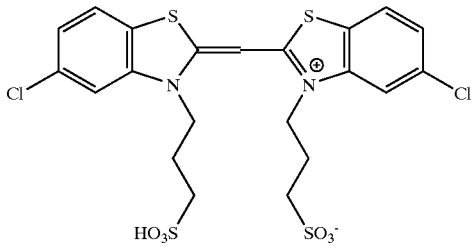

GSD-100:

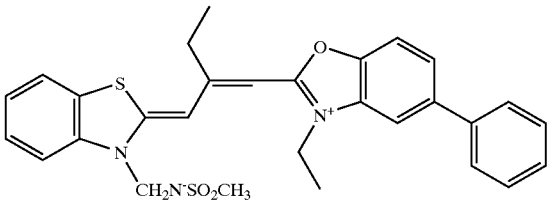

GSD-200:

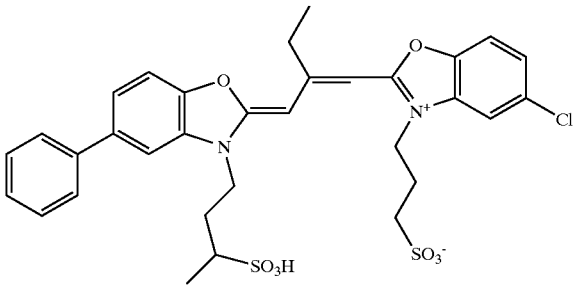

GSD-300:

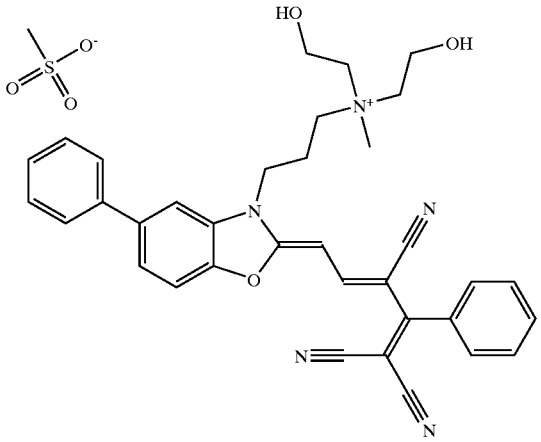

-continued

RSD-100:

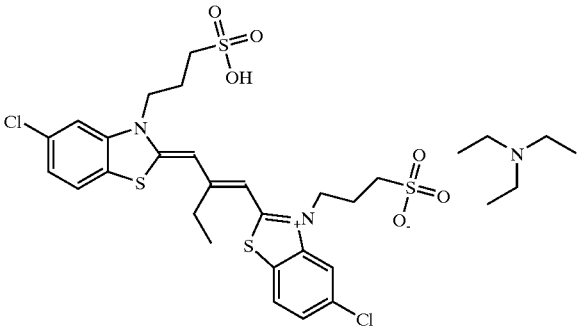

RSD-200:

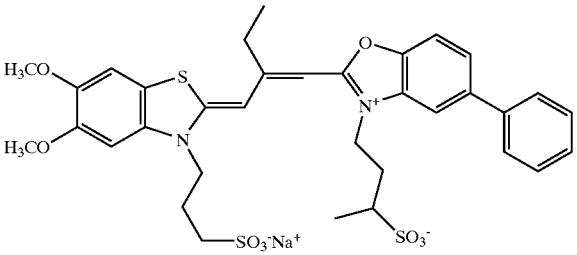

Multilayer Performance and Interpretations

All multilayer samples were given stepwise exposures with a light source simulating tungsten illuminant (3200K) as previously discussed. The exposed multilayer samples were developed in a Kodak ECN-2™ Process (standard 3 min 15 sec in developer bath). A complete description of the Kodak ECN-2™ Process is contained in the Kodak H-24 Manual (Manual for Processing Eastman Motion Picture Films; H-24 Manual; Eastman Kodak Company, Rochester, N.Y.) the description of which is incorporated herein by reference. Following development, the optical image dye density was measured for each step of the stepwise exposure and the characteristic profile curve was generated for each multilayer sample. Photographic sensitivity (speed point) for Multilayer Samples were measured in log units as 100*(1-logH) where H is the exposure in lux-sec necessary to produce a density 0.20 above D-min. The photographic sensitivity of Multilayer Sample 100 and 200 were set equal to zero compared to the other relevant samples. The Relative Green Speed is 100× the logH speed difference of two samples. Table I lists the relative green speeds of multilayer samples. A difference of +30 units in relative green speed represents +0.30 logH or one stop improvement of photographic sensitivity (a doubling of speed). Multilayer Samples 100 through 204 were all high speed ECN origination films designed for Tungsten exposure illuminant. Photographic sensitivity of the multilayer samples were also calculated employing the standard ISO method and were listed in Table II as Film ISO Speed.

Granularity of the above stepwise exposure on the multilayer samples was determined by the RMS method (see The Theory of the Photographic Process, 4th edition, T. H. James editor, Macmillian Publishing Co., New York, 1977) using a 48 μm aperature. RMS granularity is the root-mean-squared standard density deviation (δd) or local density variability in an area of overall uniform density. The RMS (δd) granularity from the green channel of the stepwise exposure of each multilayer sample was measured at 0.2 logE increments from the speed point through +1.8 logE (6 stops) above the speed point. The green channel RMS (δd) values over the 6 stop exposure range were squared, summed and averaged for each multilayer sample. The average δd×1000 for each multilayer sample are listed in TableII as the Integrated RMS Green Granularity. A 5% difference in RMS (δd) or Integrated RMS Granularity Green Grain between any two samples offers a noticeable difference in graininess and was defined as 1 GU (Grain Unit) by D. Zwick and D. Brothers (*J. Soc. Mot. Pict. Telev. Eng.*, Vol. 86, pp. 427–430, 1977). Multilayer Samples 100 and 200 were defined as controls and the other multilayer samples were compared to the appropriate control. Relative Green Grain (granularity expressed in Grain Units) for Multilayer Samples 101 relative to Multilayer Sample 100 are given in Table I. Relative Green Grain (granularity expressed in Grain Units) for Multilayer Samples 201 through 204 relative to Multilayer Sample 200 are given in Table II. A difference of −1 in Relative Green Grain represents a 1 GU improvement in granularity.

Linearity of the characteristic profile curve of each multilayer sample was determined in the following manor. A straight line was drawn on the characteristic profile curve of each multilayer sample from the speed point to +1.8 logE above the speed point. The sum total of the absolute density differences at 0.2 logE intervals between the straight line and characteristic profile curves is here in defined as Linearity. As the Linearity value of a characteristic profile curve approaches zero, the segment of the characteristic profile curve bridging mid-scale density begins to resemble a perfectly straight line. Linearity values for the green record of each Multilayer Sample are given in Table I and II as Green Linearity.

TABLE I

| Multilayer Sample | Comparison or Invention | FM Layer 7 Emulsion | Relative Green Speed | Relative Green Grain (GU) | Green Linearity |
|---|---|---|---|---|---|
| 100 | Comparison | D | 0 | 0 | 0.122 |
| 101 | Comparison | E | +7 | +0.4 | 0.135 |

TABLE II

| Multilayer Sample | Comparison or Invention | MM Layer 6 Emulsion | SM Layer 5 Emulsion | Film ISO Speed | Integrated RMS Green Grain (δd) | Green Linearity |
|---|---|---|---|---|---|---|
| 200 | Comparison | F | A | 830 | 11.236 | 0.109 |
| 201 | Comparison | G | A | 814 | 11.234 | 0.108 |
| 202 | Invention | H | A | 804 | 10.467 | 0.222 |
| 203 | Invention | H | Blend 50% A 50% B | 787 | 10.562 | 0.049 |
| 204 | Invention | H | I | 789 | 10.513 | 0.053 |

As demonstrated with the data in Table I, application of layered dye spectrally sensitized emulsion technology in the fastest magenta layer produced increased Relative Green Speed with some degradation in Relative Green Grain. (Multilayer Sample 101 was compared relative to the performance of Multilayer Sample 100). This is consistent with the findings of Parton et al (U.S. Pat. No. 5,629,76) who taught layered dye spectral sensitization in a singlelayer elements can produce increased photographic sensitivity. However, in this multilayer element, addition of a layered dye spectrally sensitized emulsion unfortunately also produced poorer linearity.

Application of dye layered spectrally sensitized emulsions in intermediate speed layers was surprisingly more advantageous. A comparison of two non-dye layered emulsions of different size in the mid magenta layer produced very little effect on multilayer performance (Multilayer Sample 200 vs 201). Substitution of a dye layered emulsion into only one of the intermediate speed layers (Layer 6) produced a significant improvement in Relative Green Granularity (Multilayer Sample 201 vs 202) but Linearity was degraded. Blending emulsions of various grains size is a technique often employed in the art to manipulate curve-shape. Upon blending a larger non-layered dye emulsion component into Slow Magenta Layer 5 in combination with a layered dye spectrally sensitized emulsion only in Mid Magenta Layer 6, superior granularity and Linearity were achieved (Multilayer Sample 201 vs 203). Applying Layered Dye spectrally sensitized emulsions technology in both Mid and Slow Magenta Layers 6 and 5 also produced outstanding granularity and linearity performance (Multilayer Samples 201 vs 204).

In contrast to application of dye layered spectral sensitizing dye in the fastest layer, these data demonstrate that a photographic material comprising dye-layered tabular emulsions in intermediate speed layers produces an unexpected photographic performance improvement characterized by a combination of lower granularity and extended linearity at high photographic speed. This is a superior level of performance which here to for has never been disclosed for a high speed multilayer element.

This invention has been described in detail with particular reference to certain preferred embodiments thereof, but it will be understood that variations and modifications can be effected within the spirit and scope of the invention.

What is claimed is:

1. A silver halide photographic capture or origination element comprising a support bearing a cyan dye image-forming unit comprised of at least one red-sensitive silver halide emulsion layer having associated therewith at least one cyan dye-forming coupler, a magenta dye image-forming unit comprising more than one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein said photographic element has ISO speed rating of 800 or more and has an integrated RMS green granularity equal to or less than 11.2.

2. The silver halide photographic element of claim 1 wherein the photographic element has an integrated RMS green granularity equal to or less than 10.6.

3. The silver halide photographic element of claim 1 wherein the magenta dye image forming unit contains silver halide em emulsion layers of differing sensitivities, said layers comprise at least a slow, a fast and an intermediate layer; and at least one layer of intermediate sensitivity contains a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

4. The silver halide photographic element of claim 3 wherein Dye 1 comprises at least one anionic substituent, and Dye 2 comprises at least one cationic substituent.

5. The silver halide photographic element of claim 3 wherein Dye 1 is a cyanine dye and Dye 2 is a dye other than a cyanine dye.

6. The silver halide photographic element of claim 4 wherein Dye 1 is a cyanine dye and Dye 2 is a dye other than a cyanine dye.

7. The silver halide photographic element of claim 3 wherein the dye layered silver halide emulsion has an average ECD grain size of less than 1.3 $\mu$m.

8. The silver halide photographic element of claim 3 wherein the dye layered silver halide emulsion has an average ECD in size of less than 1.1 $\mu$m.

9. The silver halide photographic element of claim 3 wherein the magenta dye image forming unit has a linearity of less than 0.10.

10. The silver halide photographic element of claim 3 wherein the magenta dye image forming unit has a linearity of less than 0.06.

11. The silver halide photographic element of claim 3 wherein the photographic element further comprises development promoting agent.

12. The silver halide photographic element of claim 3 wherein the magenta dye image forming unit further comprises a development promoting agent.

13. A silver halide photographic capture or origination element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion Layer having associated therewith at least one magenta dye-forming coupler, and a yellow dye image-forming unit comprising at least one blue-sensitive silver halide emulsion layer having associated therewith at least one yellow dye-forming coupler, wherein at least one of the dye image forming units contains layers of differing sensitivities, said layers comprise at least a slow, a fast and an intermediate layer and at least one layer of intermediate sensitivity contains a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer where the dye layered emulsion is in the magenta dye image forming unit and the photographic element has an ISO speed rating of 400 or greater and has an integrated RMS green granularity equal to or less than 10.6.

14. The silver halide photographic element a claim 13 wherein Dye 1 comprises at least one anionic substiutent, and Dye 2 comprises at least one cationic substitutent.

15. The silver halide photographic element of claim 13 wherein Dye 1 is a cyanine dye and Dye 2 is a dye other than a cyanine dye.

16. The silver halide photographic element of claim 14 wherein Dye 1 is a cyanine dye and Dye 2 is a dye other than a cyanine dye.

17. The silver halide photographic element of claim 13 wherein the dye layered silver halide emulsion has an average ECD grain size of less than 1.3 $\mu$m.

18. The silver halide photographic element of claim 13 wherein the dye layered silver halide emulsion has an average ECD grain size of less than 1.1 $\mu$m.

19. The silver halide photographic element a claim 13 wherein the dye image forming unit containing the dye layered silver halide emulsion has a linearity of less than 0.10.

20. The silver halide photographic element of claim 13 wherein the dye image forming unit containing the dye layered silver halide emulsion has a linearity of less than 0.06.

21. The silver halide photographic element of claim 13 wherein the dye layered emulsion is in the magenta dye image forming unit and the photographic element has an ISO speed rating of 800 or greater an has an integrated RMS green granularity equal to or less than 11.2.

22. The silver halide photographic element of claim 13 wherein the dye layered emulsion is in the magenta dye image forming unit and the photographic element has an ISO speed rating of 800 or greater.

23. The silver halide photographic element of claim 13 wherein the dye image forming unit containing the dye layered silver halide emulsion is the magenta dye image forming unit.

24. The silver halide photographic element of claim 13 wherein the photographic element further comprises a development promoting agent.

25. The silver halide photographic element of claim 13 wherein the dye image forming unit containing the dye layered silver halide emulsion further comprises a development promoting agent.

26. A silver halide photographic capture or origination element comprising a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein the magenta dye image forming units contains layers of differing sensitivities, said layers comprise at least a slow, a fast and an intermediate layer; and at least one layer of intermediate sensitivity contains a silver halide emulsion comprising tabular silver halide grains having associated therewith at least two dye layers comprising (a) an inner dye layer adjacent to the silver halide grain and comprising at least one dye, Dye 1, that is a cyanine dye comprising at least one anionic substituent and that is capable of spectrally sensitizing silver halide and (b) an outer dye layer adjacent to the inner dye layer and comprising a least one dye, Dye 2, that is not a cyanine dye and that comprises at least one cationic substituent; wherein the dye layers are held together by more than one non-covalent force; the outer dye layer absorbs light at equal or higher energy than the inner dye layer; and the energy emission wavelength of the outer dye 1 layer overlaps with the energy, absorption wavelength of the inner dye layer; wherein the photographic element has an ISO speed rating of 800 or more and an integrated RMS green granularity equal to or less than 11.2 and wherein the magenta dye image forming unit has a linearity of less than 0.10.

27. The silver halide photographic element a claim 26 wherein the dye layered silver halide emulsion has an average ECD grain size of less than 1.3 $\mu$m.

28. The silver halide photographic element of claim 26 wherein the dye layered silver halide emulsion has an average ECD grain size of less than 1.1 $\mu$m.

29. The silver halide photographic element of claim 26 wherein the photographic element has an ISO speed rating of 800 or greater and has an integrated RMS green granularity equal to or less than 10.6.

30. The silver halide photographic element of claim 26 wherein the photographic element further comprises a development promoting agent.

31. The silver halide photographic element of claim 26 wherein the dye image forming unit further comprises a development promoting agent.

32. The silver halide photographic element of claim 3 wherein at least one layer of slow sensitivity contains a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

33. The silver halide photographic element of claim 13 wherein at least one layer of slow sensitivity contains a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

34. A silver halide photographic capture or origination element comprising a support bearing a cyan dye image-forming unit comprised of at least one red-sensitive silver halide emulsion layer having associated therewith at least one cyan dye-forming coupler, a magenta dye image-forming unit comprising more than one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, wherein said photographic element has an ISO speed rating of 400 or more and has an integrated RMS green granularity equal to or less than 10.6.

35. The silver halide photographic element of claim 34 wherein the magenta dye image forming unit contains silver halide emulsion layers of differing sensitivities, said layers comprise at least a slow, a fast and an intermediate layer; and at least one layer of intermediate sensitivity contains a silver halide emulsion comprising tabular silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein the dye layers are held together by more than one non-covalent force; the outer dye layer absorbs light at equal or higher energy than the inner dye layer; and the energy emission wavelength of the outer dye layer overlaps with the energy absorption wavelength of the inner dye layer.

36. The silver halide photographic element of claim 35 wherein Dye 1 comprises at least one anionic substiutent, and Dye 2 comprises at least one cationic substitutent.

37. The silver halide photographic element of claim 35 wherein Dye 1 is a cyanine dye and Dye 2 is a dye other than a cyanine dye.

38. The silver halide photographic element of claim 36 wherein Dye 1 is a cyanine dye and Dye 2 is a dye other than a cyanine dye.

39. The silver halide photographic element of claim 34 wherein the dye layered silver halide emulsion has an average ECD grain size of less than 1.3 $\mu$m.

40. The silver halide photographic element of claim 34 wherein the dye layered silver halide emulsion has an average ECD grain size of less than 1.1 $\mu$m.

41. The silver halide photographic element of claim 34 wherein the magenta dye image forming unit has a linearity of less than 0.10.

42. The silver halide photographic element of claim 34 wherein the magenta dye image forming unit has a linearity of less than 0.06.

43. The silver halide photographic element of claim 34 wherein the photographic element further comprises a development promoting agent.

44. The silver halide photographic element of claim 34 wherein the magenta dye image forming unit further comprises a development promoting agent.

* * * * *